United States Patent [19]

Sears

[11] 3,930,545

[45] Jan. 6, 1976

[54] TILTABLE COUPLING

[75] Inventor: Howard V. Sears, Flat River, Mo.

[73] Assignee: St. Joe Minerals Corporation, New York, N.Y.

[22] Filed: Nov. 29, 1973

[21] Appl. No.: 419,924

Related U.S. Application Data

[60] Continuation-in-part of Ser. No. 219,813, Jan. 21, 1972, Pat. No. 3,817,336, which is a continuation-in-part of Ser. No. 25,885, April 6, 1970, abandoned, which is a division of Ser. No. 685,671, Nov. 24, 1967, Pat. No. 3,571,937.

[52] U.S. Cl. ..... 175/45; 33/312; 175/61; 175/76; 175/106; 175/107; 175/103; 415/122

[51] Int. Cl.[2] ..... E21B 47/02

[58] Field of Search ..... 175/73, 76, 92, 94, 106, 175/107, 45; 415/122; 33/312, 366

[56] References Cited

UNITED STATES PATENTS

| | | | |
|---|---|---|---|
| 710,935 | 10/1902 | Avery | 175/107 X |
| 1,476,747 | 12/1923 | Wolever | 175/107 X |
| 1,747,398 | 2/1930 | Short | 175/106 X |
| 1,850,403 | 3/1932 | Relee | 175/74 |
| 2,674,049 | 4/1954 | James | 33/312 |
| 2,796,234 | 6/1957 | Mann | 175/76 |
| 2,891,769 | 6/1959 | Page | 175/76 |
| 3,068,946 | 12/1962 | Frisby et al. | 175/73 |
| 3,083,779 | 4/1963 | Rowley | 175/107 |
| 3,298,449 | 1/1967 | Bachman et al. | 175/76 |
| 3,407,887 | 10/1968 | Vivion | 175/106 |
| 3,561,549 | 2/1971 | Garrison | 175/76 |

*Primary Examiner*—Frank L. Abbott
*Assistant Examiner*—Richard E. Favreau
*Attorney, Agent, or Firm*—Rogers, Ezell & Eilers

[57] ABSTRACT

A tiltable coupling has one end thereof connected to a down-hole drill and has the other end thereof connected to a section of drill rod. By using that tiltable coupling, it is possible to cause a down-hole drill to drill curved holes in subterranean formations. That tiltable coupling serves to connect the section of drill rod to the down-hole drill, and also serves as a conduit for the compressed air which must be supplied to that down-hole drill.

One preferred embodiment of the tiltable coupling has a fulcrum at one side thereof and has a piston at the opposite side thereof; and that piston will be left inactive whenever a straight section of the hole is to be drilled, but that piston will be actuated whenever a curved section of that hole is to be drilled. Sensors are incorporated into the tiltable coupling to indicate the attitude of the down-hole drill, and some of them lie in a plane at right angles to the plane in which the axis of the piston lies; and hence those sensors can indicate the attitude of the plane in which the curved section of the hole will lie.

24 Claims, 19 Drawing Figures

TILTABLE COUPLING

CROSS REFERENCE TO RELATED APPLICATION

This application is a continuation-in-part of my application Ser. No. 219,813 filed Jan. 21, 1972 and granted June 18, 1974 as U.S. Pat. No. 3,817,336 which, in turn, is a continuation-in-part of my application Ser. No. 25,885, filed Apr. 6, 1970 but abandoned June 10, 1972 which was a division of my application Ser. No. 685,671 filed Nov. 24, 1967 and granted Mar. 23, 1971 as U.S. Pat. No. 3,571,937.

BACKGROUND OF THE INVENTION

This invention relates to a tiltable coupling which can connect a section of drill rod to a down-hole drill to permit that down-hole drill to drill curved holes in subterranean formations.

DESCRIPTION OF THE PRIOR ART

It frequently is desirable to drill curved holes rather than straight holes in subterranean formations; and whipstocks and steel wedges have been used to cause drills to form curved holes. However, the use of whipstocks and of steel wedges is objectionable because of the time and labor which their use entails and also because whipstocks and steel wedges cannot cause drills to form curved holes having radii of 600 feet or less.

SUMMARY OF THE INVENTION

The present invention provides a tiltable coupling which has one end thereof connected to a down-hole drill and which has the other end thereof connected to a section of drill rod. By using that tiltable coupling, it is possible to cause a down-hole drill to drill curved holes in subterranean formations. That tiltable coupling serves to connect the section of drill rod to the down-hole drill, and also serves as a conduit for the compressed air which must be supplied to that down-hole drill. It is, therefore, an object of the present invention to provide a tiltable coupling which connects a down-hole drill to a section of drill rod, which causes that down-hole drill to drill curved holes in subterranean formations, and which serves as a conduit for the compressed air which must be supplied to that down-hole drill.

One preferred embodiment of the tiltable coupling has a fulcrum at one side thereof and has a piston at the opposite side thereof; and that piston will be left inactive whenever a straight section of the hole is to be drilled, but that piston will be actuated whenever a curved section of that hole is to be drilled. It is, therefore, an object of the present invention to provide a tiltable coupling which has a fulcrum at one side thereof and which has a piston at the opposite side thereof and which can cause a down-hole drill to drill a curved section of a hole in a plane that includes the axis of that piston.

Sensors are incorporated into the tiltable coupling of the present invention to indicate the attitude of the down-hole drill; and some of them lie in a plane at right angles to the plane in which the axis of the piston lies. As a result, those sensors can indicate the attitude of the plane in which the curved section of the hole will lie. It is, therefore, an object of the present invention to provide a tiltable coupling with sensors which indicate the attitude of the down-hole drill and which lie in a plane at right angles to the plane in which the axis of the piston lies.

Other and further objects and advantages of the present invention should become apparent from an examination of the drawing and accompanying description.

In the drawing and accompanying description, two preferred embodiments of the present invention are shown and described, but it is to be understood that the drawing and accompanying description are for the purpose of illustration only and do not limit the invention and that the invention will be defined by the appended claims.

DESCRIPTION OF THE PREFERRED EMBODIMENTS

Figure 1:
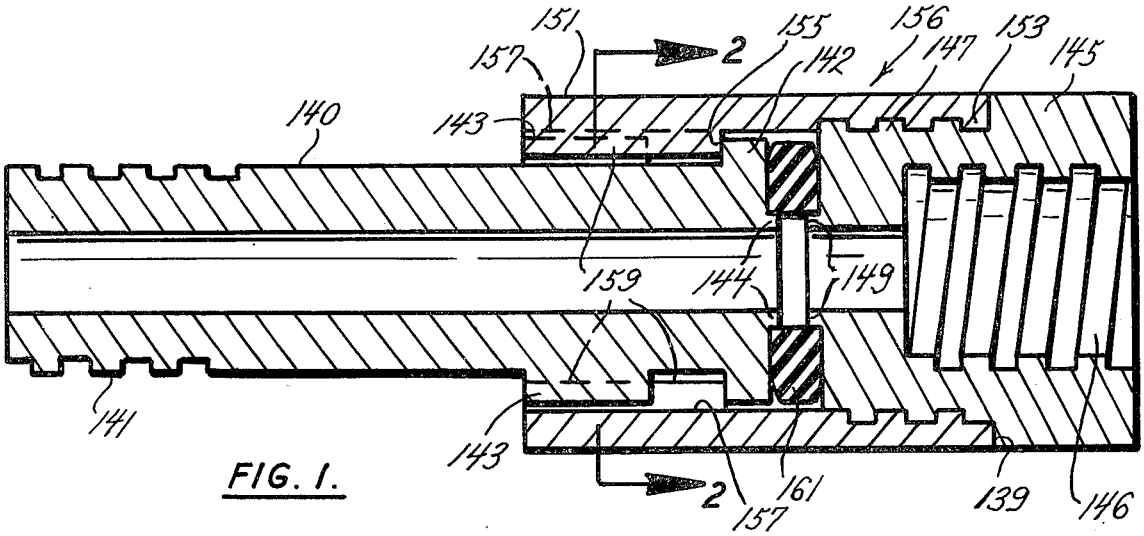
FIG. 1 is a longitudinal section through one preferred embodiment of tiltable coupling that is made in accordance with the principles and teachings of the present invention.
Figure 2:
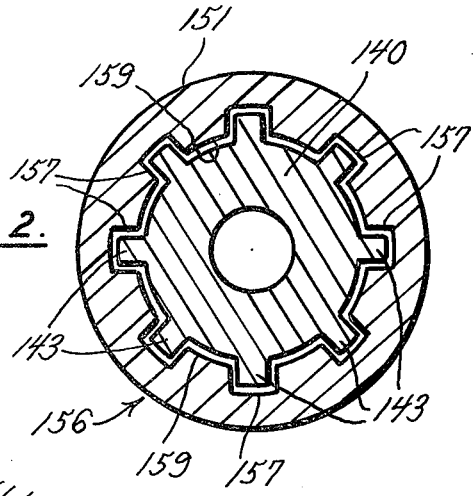
FIG. 2 is a sectional view through the tiltable coupling of FIG. 1, and it is taken along the plane indicated by the line 2—2 of FIG. 1.
Figure 3:
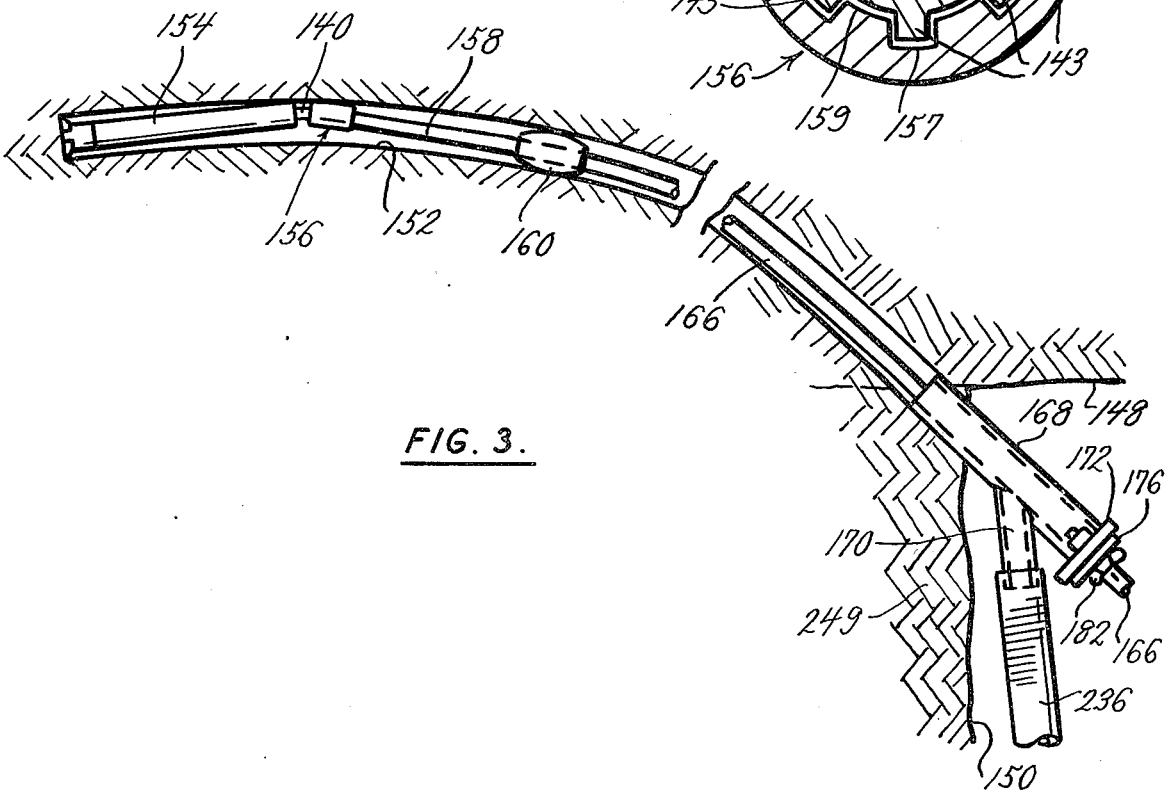
FIG. 3 is a vertical section, on a smaller scale, through a curved prospect boring in a subterranean formation which is being formed by a down-hole drill that is coupled to a drill rod by the tiltable coupling of FIG. 1.

Referring particularly to FIGS. 1–3, the numeral 156 generally denotes one preferred embodiment of tiltable coupling that is made in accordance with the principles and teachings of the present invention. That tiltable coupling includes a tube 140 which has a radially-extending flange 142 at the right-hand thereof, which has axially-extending splines 143 spaced a short distance to the left of that radially-extending flange, and which has a thin, annular, axially-directed projection 144 at the right-hand face thereof. The flexible coupling 156 also includes a socket 145 which has an internal thread 146 at the right-hand end thereof, which has an external thread 147 at the left-hand end thereof, which has a shoulder 139 at the right-hand end of the external thread 147, and which has a thin, annular, axially-directed projection 149 at the left-hand face thereof. The thin, annular, axially-directed projection 149 on the socket 145 is in register with and extends toward, but stops short of, the thin, annular, axially-directed projection 144 on the tube 140. An annulus 161, of a resilient material such as rubber, is disposed between the confronting faces of the tube 140 and of the socket 145; and the thin, annular, axially-directed projections 144 and 149 hold that annulus in position between those confronting faces.

The flexible coupling 156 additionally includes a sleeve 151 which has an internal thread 153 at the right-hand end thereof that can mate with the external thread 147 on the socket 145. Also, that sleeve has a shoulder 155 which can abut the left-hand face of the radially-extending flange 142 on the tube 140, and can thereby hold the right-hand face of that tube in engagement with the resilient annulus 161. Further, the sleeve 151 has a number of axially-extending grooves 157 therein which accommodate the axially-extending splines 143 on the tube 140; and, as shown particularly by FIG. 1, those grooves extend through to the shoulder 155. The numeral 159 denotes the inner surface of the portion of the sleeve 151 in which the grooves 157 are formed.

The internal thread 146 on the socket 145 will mate with the external thread on the left-hand end of the section 158 of the drill rod string shown in FIG. 3. The external thread 141 on the left-hand end of the tube 140 will mate with an internal thread in the right-hand end of a down-hole drill 154. Although different down-hole drills could be used, a down-hole drill of the type shown in U.S. Pat. No. 3,084,683 or U.S. Pat. No. 3,361,219 would be quite useful. The internal thread 153 of the sleeve 151 will mate with the external thread 147 on the socket 145 to hold the right-hand end of that sleeve in engagement with the shoulder 139 on the socket 145, and to hold the shoulder 155 in engagement with the radially-extending flange 142. At such time, the tube 140 and the socket 145 will be in end-to-end relation, the resilient annulus 161 will be held by the thin, annular, axially-directed projections 144 and 149, and the splines 143 on that tube will be disposed within the grooves 157 of the sleeve 151. Those splines will coact with the side walls of those grooves to rotate the tube 140 — and thereby rotate the down-hole drill 154.

The inner surface 159 of the grooved portion of the sleeve 151 is machined to provide a predetermined annular gap between it and those portions of the outer surface of the tube 140 which are located between the splines 143. That annular gap determines the extent to which the axis of the tube 140 can tilt relative to the axis of the socket 145; and thereby controls the maximum angle of deflection 381 the axis of the down-hole drill 154 and the axis of the section 158 of drill rod string in FIG. 3. In doing so, that annular gap determines the radius of curvature of the prospect boring holes drilled by the down-hole drill 154 whenever the flexible coupling 156 is interposed between the down-hole coact and that drill rod section. An annular gap having a thickness in the range of forty-eight to sixty thousandths of an inch has been found to provide a radius of curvature of about 125 feet for the curved prospect boring 152. By decreasing the thickness of that annular gap, it is possible to increase the radius of curvature for that curved prospect boring. While it is theoretically possible to decrease the radius of curvature for that curved prospect boring below 125 feet, by increasing the thickness of that annular gap, frictional resistance and abrasion problems increase excessively when that radius of curvature is so decreased. The numeral 160 denotes a bushing which is generally elliptical in side elevation; and that bushing is mounted on the section 158 of drill rod. If desired, that bushing could be pressed onto that section of drill rod; but that bushing will perferably be mounted on that section of drill rod so it can not shift axially of, but can rotate relative to, that section of drill rod. The numeral 166 denotes a driving section of drill rod which has one end thereof extending into the curved prospect boring 152, and which has the other end thereof disposed outwardly of that curved prospect boring.

A collar 168 encircles the driving section 166 of drill rod; and that collar has its inner end wedged into the portion of the curved prospect boring 152 which communicates with the working 148. The collar 168 has a downwardly-directed arm 170; and a large diameter hose 236 extends from that arm to a dust sample collector, not shown. The collar 168 has perforated ears 172; and a generally-square gasket, not shown, a flexible material is shaped to abut the outer face of the collar 168 and to fit between the openings in the perforated ears 172. A gland 176, which has openings therein that can be set in register with the openings in the perforated ears 172 of the collar 168, has a large central opening therein. That large central opening in that gasket is made just large enough to snugly receive the cross section of a section of drill rod. Although the gasket could be made from different materials, it preferably is made from a length of rubber belt; because the material of which rubber belts are made is tough and has good wear-resisting qualities. The numeral 182 denotes wing bolts which can extend through the openings in the gland 176 to seat in the threaded openings of the perforated ears 172 of the collar 168. Tightening of the wing nuts 182 will tend to force the gasket into sealing engagement with any section of drill rod that extends through the large opening in that gasket.

In using the tiltable coupling 156 of FIGs. 1–3, the workman will use the down-hole drill 154 or another drill to form the initial portion of the curved prospect boring 152. Although the axis of that initial portion of that boring can be set at different angles relative to the axis of the vein 249, which extends outwardly beyond the end face 150 of the working 148 as shown by FIG. 3, the axis of that initial portion will preferably be set at an angle of from 20° to 60° relative to the axis of that vein. Once the initial portion of the curved prospect boring 152 is deep enough to fully accommodate the down-hole drill 154, the tiltable coupling 156 and the bushing 160, the workman will telescope that bushing over the section 158 of drill rod; and that down-hole drill, that tiltable coupling, and that section of drill rod will be moved into the position indicated by FIG. 3.

At such time, the forward end of the collar 168 will be tightly wedged into position within the initial portion of the curved prospect boring 152. Air then will flow through section 166 of drill rod, drill rod section 158, and flexible coupling 156 to the down-hole drill 154; all as pointed out in detail in said application Ser. No. 219,813.

The air which passes to the down-hole drill 154 will cause the end face of that drill to repeatedly strike the inner end of the curved prospect boring 152 — in the manner in which the bit of a pneumatic drill repeatedly strikes the surface against which it is held. Air pressure will cause the various sections of drill rod to apply a steady force to the down-hole drill 154 which will continuously urge the cutting face of that down-hole drill into drilling engagement with the inner end of the curved prospect boring 152. Additional air will cause a drill head, not shown, to rotate the various sections of drill rod with consequent rotation of the down-hole drill 154. As a result, that drill will form an essentially cylindrical prospecting boring.

The air which exhausts from the down-hole drill 154 will pass through the curved prospect boring 152 toward the collar 168. Because the inner end of that collar is wedged tightly into the initial portion of that curved prospect opening, little or no air can escape through the joint between that collar and that initial portion. Because the gasket, not shown, tightly encircles the last section of drill rod, little or no air can escape along the surface of that drill rod. Consequently, the air which is exhausted from the down-hole drill 154 will pass through the collar 168, will pass downwardly through the arm 170 of that collar, and then will pass through the hose 236 into the dust sample collector.

The down-hole drill 154 is relatively heavy; and it will respond to the force of gravity to tilt its axis and the axis of the tube 140 of the flexible coupling 156 downwardly relative to the axis of the socket 145 of that flexible coupling and relative to the axis of the drill rod section 158, as shown by FIG. 3. Also, the down-hole drill will apply a downwardly-directed force to the forward end of the first section of drill rod; and that downwardly-directed force will tend to bend the first section of drill rod downwardly toward the lower surface of the curved prospect boring 152. If the bushing 160 were not present, some portion of the first section of drill rod would engage that lower surface; and the distance, between the down-hole drill 154 and the portion of the first section of drill rod which engaged the lower surface of the curved prospect boring 152, would tend to vary from time to time. Any variations in that distance could be objectionable, because they could change the radius of the arc defined by the curved prospect boring 152, and they could expose long portions of the first section of drill rod to severe bending forces. However, when the bushing 160 is present, it acts as a fulcrum; and thereby keeps all or substantially all portions of the first section of drill rod from engaging the lower surface of the curved prospect boring 152. Importantly, that bushing holds the tiltable coupling 156 and the rear end of the down-hole drill 154 up out of engagement with the lower surface of that curved prospect boring 152, and thereby enables that down-hole drill to assume an inclination which is fixed by the thickness of the annular gap between the inner surface 159 of the grooved portion of the sleeve 151 and those portions of the outer surface of the tube 140 which are located between the splines 143. In addition, that bushing fixes the distance between the down-hole drill 154 and the first point along the lower surface of the curved prospect boring 152 where the drill rod string receives support from that lower surface.

The flexible coupling 156 will transmit rotational forces from the adjacent section 158 of drill rod to the down-hole drill 154, while permitting that down-hole drill to dispose its forward end below the level of its rear end. As a result, the down-hole drill 154 will automatically bore the prospect hole 152 so that prospect hole is curved. By providing various thicknesses for the annular gap between the inner surface 159 of the grooved portion of the sleeve 151 and those portions of the outer surface of the tube 140 which are located between the splines 143, it is theoretically possible to drill holes having various radii of curvature or at various rates of change of inclination, and thus to vary the minimum distance at which it is possible to intersect an extension of the vein 249. However, the smallest practical and economical radius of curvature attainable with the down-hole drill 156 is about 125 feet.

In teaching how curved prospect borings, which have radii of curvature of 600 feet or less, can be drilled in a practical manner, the present invention makes it possible, for the first time, to drill curved prospect borings from points that are located wholly in the subsurface. Not only does the present invention make the drilling of such curved prospect borings possible from points that are located wholly in the subsurface, but it makes it possible to drill such curved prospect borings quickly, inexpensively and with acceptably low levels of wear and abrasion on the drilling equipment The system of sampling an ore body, which is provided by the present invention, is most useful in providing mining officials with information regarding the thickness and grade of ore which may be encountered if workings are extended. However, that system of sampling an ore body also is useful in determining the location, dimensions and grades of related or nearby ore bodies.

While various radii could be provided for the curved prospect borings of the present invention, those radii will preferably be between 100 and 600 feet. Also, the preferred angle which is subtended between the final portion of a prospect boring and the projection of a vein will be between 20° and 60° — encompassing a total reversal of direction of 40° to 120°. While it would be possible to use a down-hole drill as large as four or more inches in diameter to drill a curved prospect boring, a smaller diameter down-hole drill is more economical. Preferably, a down-hole drill in the range of three inches in diameter will be used; and such a drill would form a boring less than 1 inch larger in diameter than its own diameter.

Figures 4, 18:
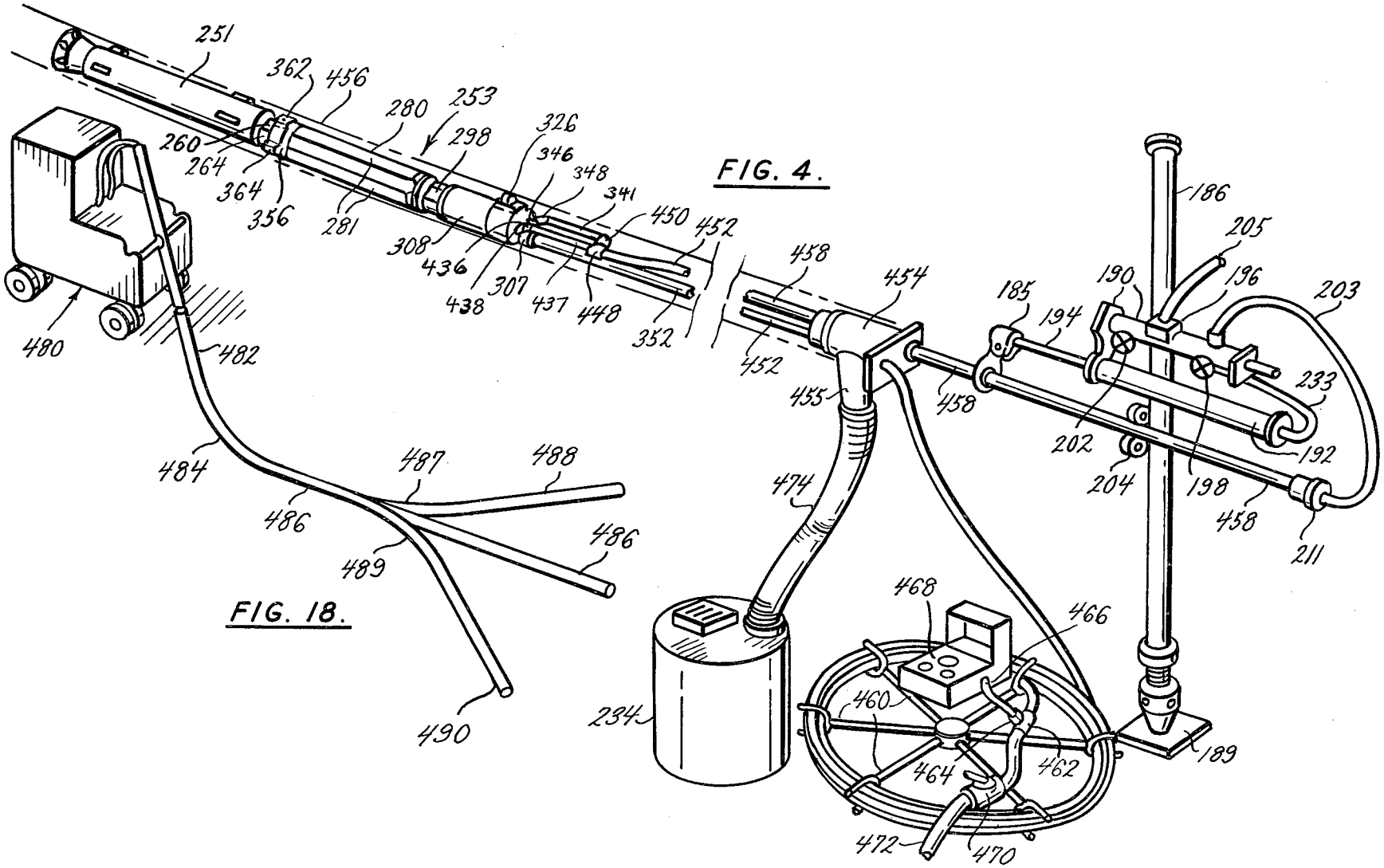
FIG. 4 is a perspective view which shows another preferred embodiment of tiltable coupling that is made in accordance with the principles and teachings of the present invention, and it shows that tiltable coupling holding a further down-hole drill within a drilled hole, and it also shows the equipment which controls the operation and advancement of that down-hole drill.
FIG. 18 is a perspective view of a hole which is straight in part, which is curved in part, and which has several horizontally-directed branches.
Figure 5A:
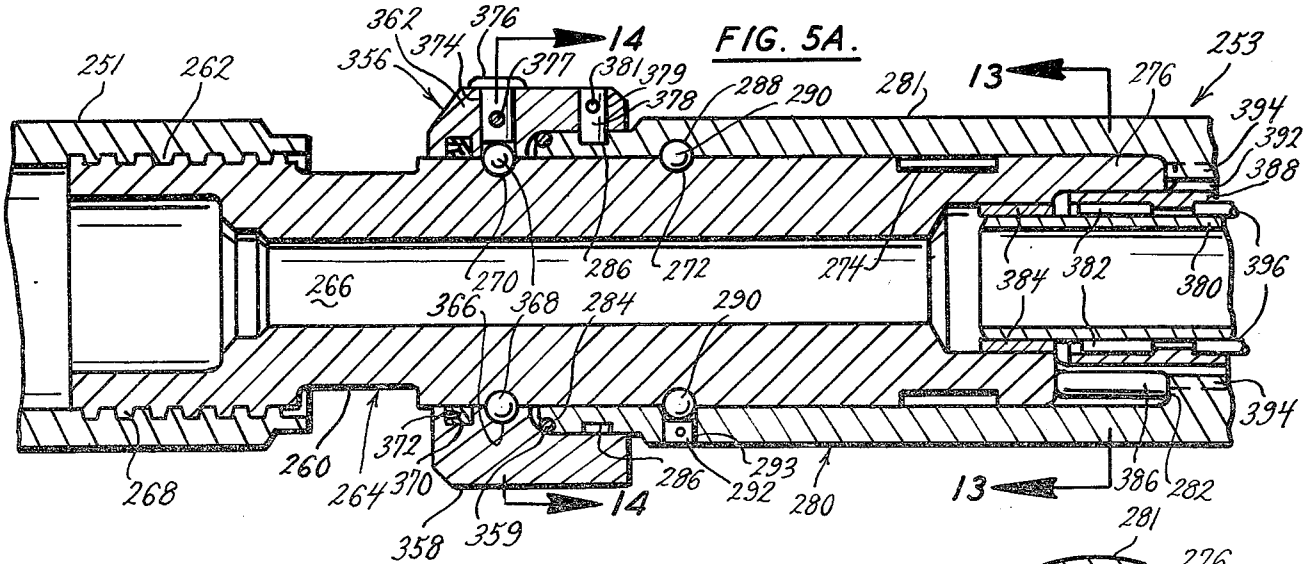
FIG. 5A is a longitudinal section through the forward end of the tiltable coupling shown in FIG. 4.
Figures 5B, 8, 9, 10, 11, 12:
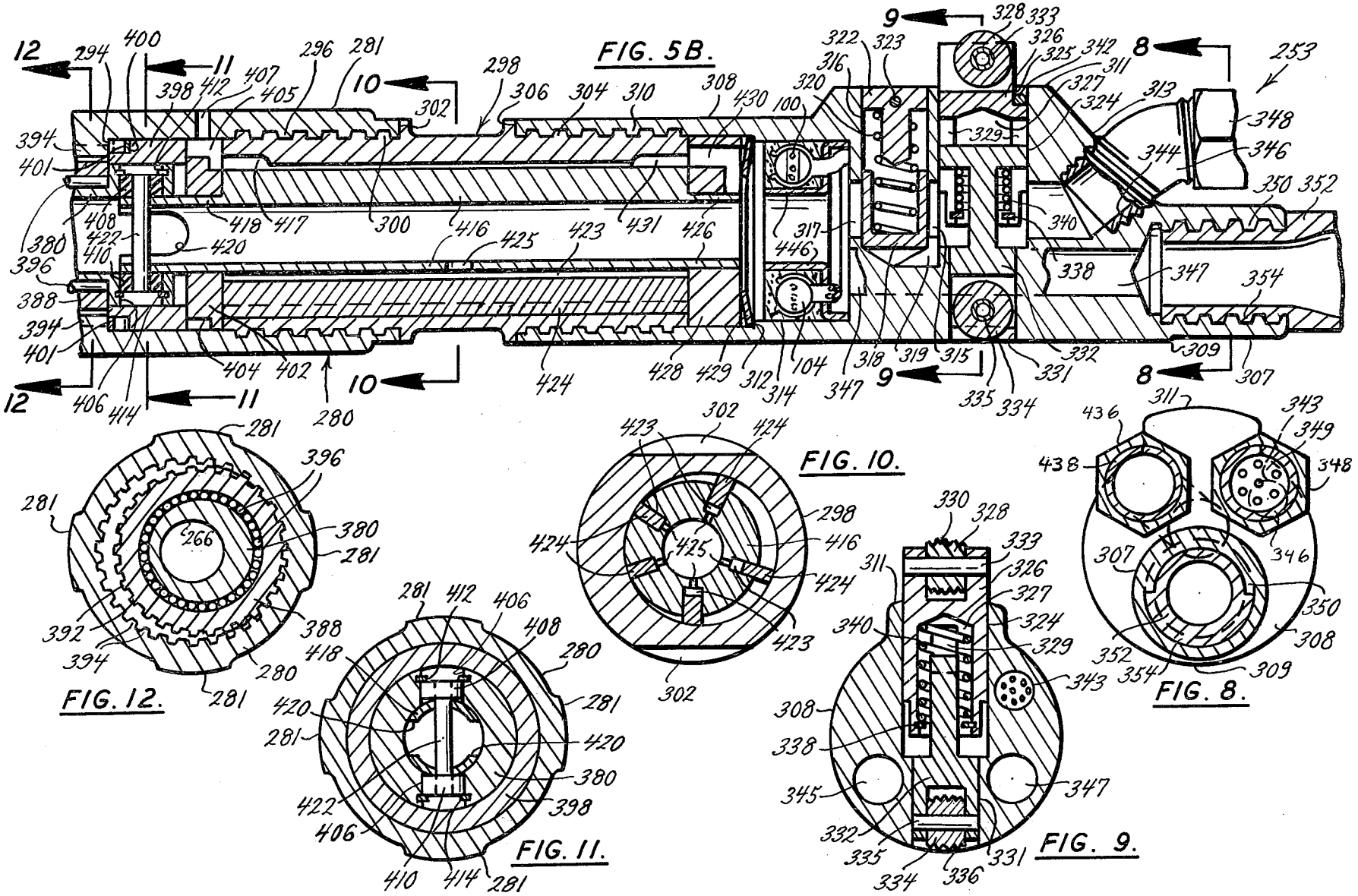
FIG. 5B is a longitudinal section through the rear end of that tiltable coupling.
FIG. 8 is a sectional view through the rear end of the tiltable coupling of FIG. 4, and it is taken along the plane indicated by the line 8—8 in FIG. 5B.
FIG. 9 is another sectional view through the rear end of the tiltable coupling of FIG. 4, and it is taken along the plane indicated by the line 9—9 in FIG. 5B.
FIG. 10 is a further sectional view through the rear end of the tiltable coupling of FIG. 4, and it is taken along the plane indicated by the line 10—10 in FIG. 5B.
FIG. 11 is a still further sectional view through the rear end of the tiltable coupling of FIG. 4, and it is taken along the plane indicated by the line 11—11 in FIG. 5B.
FIG. 12 is yet another sectional view through the tiltable coupling of FIG. 4, and it is taken along the plane indicated by the line 12—12 in FIG. 5B.

Referring particularly to FIGS. 4–5B, the numeral 251 denotes a down-hole drill which preferably will be of the type shown in U.S. Pat. No. 3,084,683 or in U.S. Pat. No. 3,361,219. That down-hole drill has a recess in the right-hand end thereof which serves as an inlet port; and the numeral 262 denotes an internal thread in that right-hand end. That internal thread is intended to mate, and is shown in FIG. 5A as mating, with an external thread 268 on a tubular rotatable element 264 which has a central pasage 266 of circular cross-section therein. That rotatably element is part of a tiltable coupling 260. The numeral 270 denotes an annular groove of semi-circular cross section which is intermediate the external thread 268 and the longitudinal center of the rotatable element 264. The numeral 272 denotes a similar annular groove which is displaced to the right of the annular groove 270. The numeral 274 denotes an annular groove of rectangular cross-section which is spaced a short distance to the left of the right-hand end of the rotatable element 264 and which contains needle bearings. Thos needle bearings will act to support and align the right-hand end of the rotatable element 264 with the sleeve 280. That rotatable element has a semi-cylindrical right-hand end 276, as shown particularly by FIGS. 5A and 13. A flat surface or jaw 278 is formed on the semi-cylindrical right-hand end 276; and a further flat surface 279 is formed on that end. As shown particularly by FIG. 13, that flat surfaces 278 and 279 define a plane which is spaced a short distance outwardly of the geometric center of the rotatable element 264.

The numeral 280 denotes a sleeve which telescopes over the right-hand end and the middle of the rotatable element 264, as shown particularly by FIG. 5A. Longitudintally-extending ribs 281 are provided at the exterior of that sleeve to enable that sleeve to be gripped and rotated by a suitable spanner-type wrench. A reduced diameter section of the sleeve 280 defines an internal shoulder 282 immediately adjacent the right-hand end of the rotatable element 264; and a small tolerance is provided between that internal shoulder and the semi-cylindrical right-hand end 276 of the rotatable element 264. The numberal 284 denotes an external annular groove in the left-hand end of the sleeve 280; and that groove is arcuate in cross-section. The numeral 286 denotes a number of radially-directed, circumferentially-spaced, sockets which are formed adjacent the left-hand end of the sleeve 280. The numeral 280 denotes an annular groove of semi-circular cross-section at the inner surface of the sleeve 280; and, as shown particularly by FIG. 5A, that groove is in register with the groove 272 in the exterior of the rotatable element 264. The annular groove 288 coacts with the annular groove 272 to define an annular space of circular cross section; and number of balls 290 are disposed within that space to help form a self-locking, anti-friction bearing. A passage 293 is formed in the wall of the sleeve 280 to facilitate the introduction of the balls 290 into that annular space; and a plug 292 will be inserted in that passage after those balls have been set in position. That plug will act to prevent accidental removal of those balls from that annular space. The numeral 294 in FIG. 5B denotes a further internal shoulder which is defined by the reduced diameter section of the sleeve 280; and the numeral 296 denotes an internal thread which is provided in the right-hand end of that sleeve.

The numeral 298 denotes the stator of a vane-type air motor; and the numeral 300 denotes an external thread on the left-hand end of that stator which can mate with the internal thread 296 in the right-hand end of the sleeve 280. The numeral 302 denotes a shoulder which projects outwardly beyond the outer surface of the external thread 300; and that shoulder will serve as a stop for the right-hand end of the sleeve 280. The numeral 304 denotes an external thread on the right-hand end of the stator 298; and the numeral 306 denotes a shoulder which extends outwardly beyond the external thread 304, as shown particularly by FIG. 5B. As shown particularly by FIG. 10, the stator 298 of the vane-type air motor has flat surfaces at the top and bottom thereof intermediate the shoulders 302 and 306 to accommodate a wrench.

The numeral 308 denotes a housing which has a tubular projection 307 at the right-end thereof; and that tubular projection is displaced a short distance upwardly from the lower surface of that housing to provide a bearing point 309 which is shown by FIGS. 5B and 8. The numeral 311 denotes a protuberance which extends upwardly from the upper surface of the housing 308, as shown particularly by FIGS. 5B, 8 and 9; and a surface 313 inclines downwardly and to the right from the right-hand end of that protuberance to the upper surface of the tubular projection 307. A threaded socket 344 is formed in the housing 308; and that socket extends inwardly from the inclined surface 313, as shown particularly by FIG. 5B. A similar threaded socket, not shown, also extends inwardly from that inclined surface.

The numeral 310 in FIG. 5B denotes an internal thread in the left-hand end of the housing 308; and that internal thread will mate with the external thread 304 on the right-hand end of the stator 298 of the vane-type air motor. An internal shoulder 312 is displaced to the right from the inner end of the internal thread 310; and a generally-cylindrical recess 314 extends inwardly from the shoulder 312. The numeral 316 denotes a cylindrical chamber which is located within, and which extends radially of, the housing 308. A cup-shaped valve 318 is slidably mounted within the chamber 316; and a helical compression spring 320 has the lower end thereof extending into the recess defined by that cup-shaped valve. A closure 322, which has a central stem, closes the upper end of the chamber 316; and that closure is held in position by a pin 323. The stem of that closure extends into the helical compression spring 320; and, as that closure is set in position, that helical compression spring will be compressed. As a result, the helical compression spring 320 will urge the cup-shaped valve 318 towards the inner end of the chamber 316. The numeral 315 denotes an inlet port for the chamber 316, the numeral 317 denotes an outlet port for that chamber, and the numeral 319 denotes a by-pass which extends from that inlet port to the inner end of that chamber.

The numeral 324 denotes a further cylindrical chamber which is located within, and which extends radially of, the housing 308; and that further chamber is parallel to, but is disposed to the right of, the chamber 316, as shown particularly by FIG. 5B. The numeral 326 denotes a piston which is slidably mounted within the chamber 324; and that piston has a flat surface 325 adjacent the outer end thereof. That flat surface will coast with a roll pin 342, which is mounted within the upper end of the chamber 324, to prevent rotation of the piston 326 within the chamber. As shown particularly by FIGS. 5B and 9, the piston 326 has an axially-extending bore 327 therein, and also has axially-extending slots 329 which extend laterally from that bore through the wall of that piston. In addition, the outer end of that piston has a slot in which a roller 328 is rotatably supported by a pivot 333. The periphery of that roller is arcuate in axial section, and that periphery is defined by a continuous thread 330. The transverse curvature of the periphery of the roller 328 is the same as the transverse curvature of the hole which will be formed by the down-hole drill 251. As a result, when that roller is moved into engagement with the inner surface of that hole, at least one portion of each turn of the thread 330 will be able to engage the interior of that hole.

The numeral 331 denotes another chamber which is located within, and which extends radially of, the housing 308; and that chamber is coaxial with the chamber 324. As shown by FIGS. 5B and 9, the cross section of the chamber 331 is smaller than the cross section of chamber 324; and those chambers are in communication with each other. Consequently, the chambers 324 and 331 coact to define a composite chamber which extends completely through the housing 308.

The numeral 332 denotes a piston which is slidably mounted within the chamber 331; and the inner end of that piston is generally T-shaped in configuration. The ends of the cross-arm of that T-shaped inner end extend into the slots 329 in the piston 326; and those ends will coact with the walls of those slots to prevent rotation of the piston 322 relative to the piston 326. The outer end of the piston 332 has a slot therein; and a roller 334 is rotatably mounted within that slot by a pivot 335. The periphery of the roller 334 is arcuate in axial section, and that periphery is defined by a continuous thread 336. The transverse curvature of the periphery of the roller 334 is the same as the transverse curvature of the hole which will be formed by the down-hole drill 251. As a result, when that roller is moved into engagement with the inner surface of that hole, at least one portion of each turn of the thread 336 will be able to engage the inner surface of that hole.

The numeral 338 denotes a snap ring which is disposed within an annular recess in the inner face of the bore 327 in the piston 326. The numeral 340 denotes a helical compression sprng; and one spring; of that helical compression spring bears against the crossarm of the T-shaped inner end of the piston 332, while the other end of that helical compression spring bears against the snap ring 338. That helical compression spring biases the pistons 326 and 332 for movement toward each other, but it can yield to permit those pistons to be moved outwardly relative to each other and outwardly relative to the housing 308. The roll pin 342 not only prevents rotation of the piston 326, and hence also of the piston 332, relative to the housing 308, but also serves to limit radial movement of the piston 326 outwardly relative to the chamber 324.

The numeral 346 denotes a pipe fitting which has one end thereof threaded into the threaded socket 344 in the housing 308, as shown by FIG. 5B. A swivel nut 348 connects a length 341 of air pressure hose to the other end of the pipe fitting 346; and an electrical connector 349 is sealed in position within that pipe fitting. A complementary electrical connector, not shown is mounted within the swivel nut 348; and that swivel nut will hold that complementary electrical connector in assembled relation with the electrical connector 349.

The numeral 438 denotes a pipe fitting which is comparable to the pipe fitting 346; and the inner end of the former pipe fitting is mounted within a threaded socket, not shown, in the housing 308 that is comparable to the threaded socket 344 in that housing. The numeral 436 denotes a swivel nut which connects a length 437 of air pressure hose to the other end of the pipe fitting 438.

the numeral 343 denotes a passage which is located within, and which extends longitudinally through, the housing 308; and that passage accommodates and protects the various electrical conductors which are connected to the various pins of the electrical connector 349. That passage and those conductors are shown particularly by FIG. 9. The numerals 345 and 347 denote additional passages which are located within, and which extend longitudinally through, the housing 308; and, as shown particularly by FIG. 9, those passages are disposed on opposite sides of the chamber 331 in that housing. The passages 345 and 347 are connected to the tubular projection 307 at the right-hand end of the housing 308; and the numeral 350 denotes an internal thread in that tubular projection.

The numeral 352 denotes a section of drill rod; and the numeral 354 denotes an external thread on the left-hand end of that section of drill rod. That external thread will mate with the internal thread 350 of the tubular projection 307, as shown by FIG. 5B. The inner diameter of the drill rod 352 is reduced adjacent the ends of that drill rod, as shown particularly by FIG. 5B; and the sum of the cross sections of the passages 345 and 347 preferably is at least equal to the internal cross section of either of the reduced-diameter ends of that drill rod.

Figure 14:
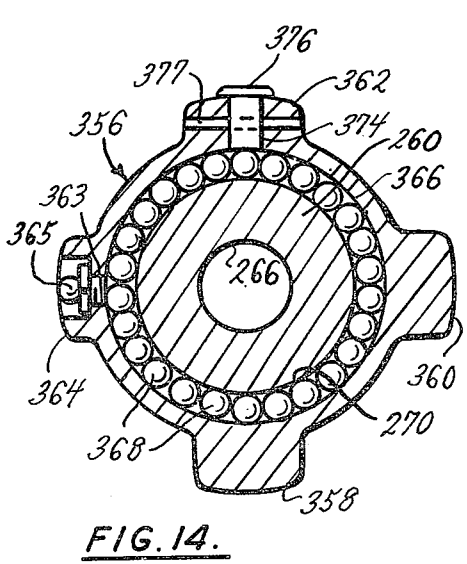
Fig. 14 is another sectional view through the front end of the tiltable coupling of FIG. 4, and it is taken along the plane indicated by the line 14—14 in FIG. 5A.

The numeral 356 in FIG. 5A generally denotes a sleevelike fulcrum; and that fulcrum has protuberances 358, 360, 362 and 364 spaced circumferentially thereof. As shown particularly by FIG. 14, the center-to-center spacings of those protuberances are 90°. The surfaces of 358 and 360 protuberances are hardened to make them highly resistant to wear and abrasion. The right-hand end of the fulcrum 356 has an enlarged inner diameter to enable that right-hand end to telescope over the left-hand end of the sleeve 280, as shown particularly by FIG. 5A. An O-ring 359 is disposed within the groove 284 in the left-hand end of the sleeve 280; and that O-ring will coact with the inner surface of the enlarged inner diameter of the right-hand end of the fulcrum 356 to provide a seal. The numeral 366 denotes an annular groove of semi-circular cross section in the inner surface of the fulcrum 356; and that annular groove is in register with the annular groove 270 of semi-circular cross section in the outer surface of the rotatable element 264. Those annular grooves will coact to define an annular space of circular cross section; and balls 368 are disposed within that annular space to help form a self-locking anti-friction bearing. The numeral 363 in FIG. 14 denotes a passage in the protuberance 364; and the numeral 365 denotes a grease fitting which is threaded into that passage. The numeral 374 denotes a radially-directed passage in the protuberance 362 of the fulcrum 356; and that passage permits the balls 368 to be introduced into the annular space defined by the annular grooves 270 and 366. A headed plug 376 is held within the passage 374 by a pin 377; and that pin will prevent accidental separation of that plug from that passage. The numeral 378 denotes a stop which is disposed within a radially-directed recess 379 in the right-hand end of the fulcrum 356; and that stop can have the inner end thereof set in any one of the radially-directed, circumferentially-spaced sockets 286 in the left-hand end of the sleeve 280. A pin 281 will prevent accidental separation of that stop from the recess 379. The numeral 370 denotes an annular groove at the interior of the fulcrum 356; and that groove is disposed to the left of the annular groove 366. An annular seal 372 is disposed within the annular groove 370; and that seal can coast with the outer surface of the rotatable element 264 to permit relative rotation of that rotatable element and of the sleeve 280 while maintaining a tight seal therebetween.

The numeral 380 denotes an eccentric sleeve which is shown in FIGS. 5A and 5B; and the left-hand end of that eccentric sleeve extends into a bushing 384 which is located within the right-hand end of the rotatable element 264. That bushing performs the dual functions of a bearing and of a seal. The left-hand end of the eccentric sleeve 380 is concentric with the bushing 384, with the tubular rotatable element 264, and with the sleeve 280, as shown particularly by FIG. 5A. The numeral 382 denotes needles which coact with the outer surface of part of the eccentric intermediate portion of the eccentric sleeve 380 and with the left-hand end of the inner surface of a hollow gear 388 to constitute a needle bearing. As indicated particularly by FIG. 13, that part of the eccentric intermediate portion of the eccentric sleeve 380 is eccentric of the tubular rotatable element 264 and of the sleeve 280. Further, as shown particularly by FIG. 13, approximately one-half of the teeth at the left-hand end of that hollow gear have been machined away to define flat surfaces 383 and 385 and to provide an intervening gear segment with an angular extent of about 180°. Further needles 396 coact with the outer surface of a further part of the accentric intermediate portion of the eccentric sleeve 380 and with the right-hand end of the inner surface of the hollow gear 388 to constitute a further needle bearing. As shown particularly by FIG. 12, that further part of the eccentric intermediate portion of the eccentric sleeve 380 is eccentric of the tubular rotatable member 264 and of the sleeve 280. That right-hand end of that hollow gear has teeth 392 extending all the way around the periphery thereof, as shown particularly by FIG. 12. The flat surface 385 at the left-hand end of the hollow gear 388 is in register with the flat surface 278 on the right-hand end of the rotatable element 264; and a roller 386, of the type used in roller bearings, is interposed between those flat surfaces. Approximately one-half of the teeth 292 extend all the way to the left-hand end of the hollow gear 388; and the rest of those teeth terminate about midway between the needles 382 and 386 — where about one-half of the teeth 392 have been machined away to define that flat surfaces 383 and 385. Where machining practices and equipment permit, the portion of the left-hand end of the hollow gear 388 which is not machined away can be left smooth and not provided with teeth 392. In one preferred embodiment of the present invention, there are 29 teeth 392 at the right-hand end of the hollow gear 388.

The numeral 394 denotes internal teeth in the sleeve 280; and, in the said preferred embodiment of the present invention, there are 30 of those teeth. As indicated particularly by FIG. 12, the pitch diameter of the hollow gear 388 is smaller than the pitch diameter of the teeth 394 at the interior of the sleeve 280. Further, as indicated particularly by FIG. 12, rotation of the eccentric sleeve 380 relative to the hollow gear 388 can cause that hollow gear to move laterally with respect to the teeth 394 at the interior of the sleeve 280. The resulting wobbling action of that hollow gear will enable clockwise rotation of the eccentric sleeve 380 in FIG. 12 to cause that hollow gear to act through the flat surfaces 385 and 278 and through the roller 386 to rotate the rotatable element 264 in that same direction. Each revolution of the eccentric sleeve 380 will advance the rotatable element 264 a distance equal to the width of a tooth 392; and hence a 30-to-1 reduction in speed and a 30-to-1 increase in torque are provided.

The numeral 398 denotes a bushing which is telescoped within the right-hand end of the sleeve 280; and the inner diameter of that bushing is just slightly greater than the outer diameter of a flange at the right-hand end of the eccentric sleeve 380. That flange is concentric with that bushing and with the sleeve 280, as shown particularly in FIG. 5B. The bushing 398 has a reduced-diameter portion 400 at the left-hand end thereof, as shown particularly by FIG. 5B; and that reduced-diameter portion accomodates a wave-type washer 401. One face of that wave-type washer bears against the shoulder 294 at the interior of the sleeve 280, while the other face of that wave-type washer bears against the full-diameter portion of the bushing 398; and that wave-type washer urges that bushing to the right in FIG. 5B. The numeral 402 denotes an annular closure for the left-hand end of the stator 298 of the vane-type air motor; and that closure is disposed within the sleeve 280, as shown particularly by FIG. 5B. A reduced-diameter portion 404 is provided at the left-hand end of the closure 402; and that reduced-diameter portion defines an annular passage which is in register with an outlet port 407 in the sleeve 280. The numeral 405 denotes an axially-extending passage which is located within the closure 402 and which connects the reduced-diameter portion 404 with an axially-extending passage 417 in the left-hand end of the rotor 416 of the vane-type air motor.

Grease forced into the grease fitting 365 will spread, in the annular tolerances between sleeve 280 and rotatable element 264 and eccentric sleeve 380, to lubricate the balls 290 in their races, the needle bearings in the annular groove 274, the needle bearings 382 and 396, the gear teeth 394 and 392, the surface 385, the hollow gear 388, and the bushings 384 and 398 which support the eccentric sleeve 380. The gears and bearing thus are encased in a sealed, lubricant-filled area and are cooled by the air which passes through the bore of the eccentric sleeve 380.

The numeral 406 denotes a diametrical diametral in the flange at the right-hand end of the eccentric sleeve 380; and that passage is shown particularly by FIGS. 5B and 11. Resilient washers 408 and 410 are disposed adjacent the upper and lower ends of that passage, respectively; and snap rings 412 and 414 are disposed radially outwardly of those resilient washers. The reduced-diameter left-hand end of the rotor 416 under-lies those resilient washers and will keep those resilient washers from moving radially inwardly in that passage; and those snap rings will keep centrifugal forces from moving those resilient washers radially outwardly in that passage.

A roll pin 422 extends through aligned openings in the reduced-diameter left-hand end 418 of the rotor 416 and extends into the resilient washers 408 and 410. The frictional forces between that roll pin and those aligned openings will prevent any radial movement between that pin and those washers. However, the resilient nature of those washers will enable those washers to compensate for any possible axial misalignments of the rotor 416 with the eccentric sleeve 380.

The intermediate portion of the rotor 416 has elongated axially-extending slots 423 therein which accommodate radially-movable elongated vanes 424. Radially-directed air passages 425 extend between the hollow center of the rotor 416 and the inner ends of the elongated axially-extending slots 423; and, as a result, air within the hollow center of that rotor will urge the outer faces of those elongated vanes into sealing engagement with the inner surface of the stator 298. That inner surface is eccentric of the axis of the rotor 416, as shown by FIG. 10.

The reduced-diameter left-hand end 418 of the rotor 416 coacts with the intermediate portion of that rotor to define a shoulder; and the right-hand face of the closure 402 abuts that shoulder to effectively close the left-hand ends of the slots 423 in the rotor 416. The sides of that reduced-diameter left-hand end are cut away, as indicated by the numeral 420 in FIGS. 5B and 11, to keep the pin 422 from reducing the effective cross section of the path for the air which will flow through the hollow center of the rotor 416. That rotor has a reduced-diameter right-hand end 426 which extends into a closure 428 that is disposed within the housing 308. That reduced-diameter end coacts with the intermediate portion of the rotor 416 to define a shoulder; and the left-hand face of the closure 428 abuts that shoulder to effectively close the right-hand ends of the slots 423 in that rotor. A Belleville washer 429 has the outer periphery thereof bearing against the shoulder 312 at the inner surface of the housing 308, and has the inner periphery thereof bearing against the right-hand face of the closure 428. That Belleville washer will coact with the wave-type washer 401 to hold the closures 402 and 428 in intimate engagement with the shoulders at the left-hand and right-hand ends, respectively, of the rotor 416. The numeral 430 denotes an axially-extending passage in the closure 428 which connects a passage 431 in the interior of the stator 298 with the recess 314 in the housing 308.

The numerals 100, 102, 104 and 106 denoted sensors which are mounted on an annular support 446 by resilient clips 444; and that annular support is disposed within the recess 314 in the housing 308. If desired, a press fit could be provided between the outer periphery of the annular support 446 and the inner surface of that recess; or, if desired, screws or other fasteners could be used to hold that annular support in position within that recess. The sensors 100, 102, 104 and 106 are hermetically-sealed electrolytic potentiometers of standard and usual design; and each of those sensors has three parallel electrodes and an electrolyte. The conductors which extend through the pipe fitting 346 connect those electrodes to a sensing circuit; and one sensing circuit to which those electrodes could be connected would be an A.C. version of the sensing circuit shown in U.S. Pat. No. 3,571,937. In fact, when that sensing circuit has had an inverter added to it, to avoid the electolytic action which would occur if the sensors 100, 102, 104 and 106 were supplied with D.C., those sensors can be directly substituted for the identically-numbered potentiometers in that patent.

Figure 15:
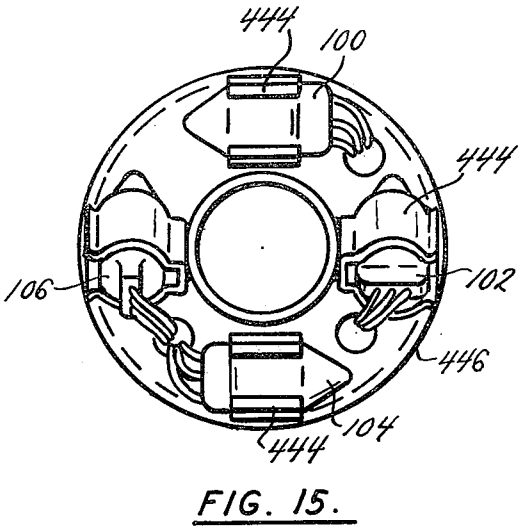
FIG. 15 is an end elevational view of an annular support and of four sensors which are mounted on that support.
Figure 16:
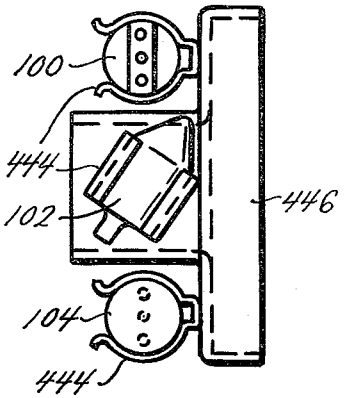
FIG. 16 is a side elevational view of the support and sensors of FIG. 15.
Figure 17:
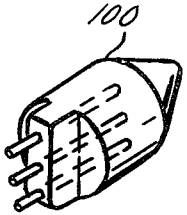
FIG. 17 is a perspective view, on a larger scale, of one of the sensors shown in FIGS. 15 and 16.

The sensors 100 and 104 are mounted on the annular support 446 so the axes thereof are parallel to each other and are at right angles to the axis of the housing 308; but the pointed end of the sensor 100 is directed to the left in FIG. 15 whereas the pointed end of the sensor 104 is directed to the right. The sensors 100 and 104 are oriented so the three electrodes of each of them lie in a plane which is parallel to the plane defined by the annular support 446, as shown by FIGS. 15 and 16. The sensors 102 and 106 are mounted on the annular support 446 so the axes thereof are parallel to each other and so the pointed ends thereof extend in the same direction; but the axes of those sensors are displaced about 55° from the axis of the housing 308, as indicated by FIGS. 15 and 16. Furthermore, the sensor 106 is mounted on the annular support 446 so the three electrodes thereof define a plane which is at right angles to the plane defined by that annular support; and the sensor 102 is mounted on that annular support so the three electrodes thereof define a plane which is at right angles to the plane defined by the three electrodes of the sensor 106.

The sensitivity curve of each of the sensors 100, 102, 104 and 106 shows that the output voltage of that sensor varies as the axis of that sensor deviates from true vertical; and also shows that the rate of change in the output voltage per degree of deviation is least when the axis of that sensor is vertical and is greatest when that axis is displaced about 35° from true vertical. To enable the sensor 106 to indicate, with a high degree of sensitivity, any tilting of the longitudinal axis of the tiltable coupling 253 from true horizontal, that sensor has the axis thereof lying in a plane which is coplanar with a vertical plane through that longitudinal axis and also has its axis lying in a plane which is diplaced about 35° from the plane of the annular support 446.

Whenever any one of the sensors 100, 102, 104 and 106 is disposed so gravity causes the electrolyte therein to immerse equal lengths of the electrodes of that sensor, the electrical resistances of the paths, which that electrolyte provides between the center-most electrode and each of the side-most electrodes, will be exactly the same. Such a condition can exist only when the axis of that sensor is precisely vertical. However, when the extent of immersion of the center electrode of a sensor is less than the extent of immersion of one of the outermost electrodes, but is greater than the extent of immersion of the other of those outermost electrodes, the resistances of the electrical oaths between that center electrode and the outer electrodes will be unequal. Consequently, the sensors 100, 102, 104 and 106 are able to sense deviations of the axes thereof from true vertical.

It should be noted that the clips 444 which secure the sensors 100 and 104 to the annular support 446 define a line that is parallel to the axis of the piston 326; and that when the housing 308 is in the position of FIG. 5B that annular support will be in the position shown by FIGS. 15 and 16. This means that when the tiltable coupling 253 is oriented to have the axis of the piston 326 truly vertical and to have that piston at the top thereof, the sensors 102 and 106 will have the electrodes therein directed upwardly and will have the conductors connected to those electrodes directed downwardly. At such time, the electrolyte within the sensor 102 will be immersing the same lengths of all of the electrodes in that sensor; and hence the sensing circuit, to which the sensors 100, 102, 104 and 106 are connected could respond the that sensor to indicate a null condition. Such an indication would signify that the axis of the piston 326 was lying in a vertical plane which passed through the axis of the tiltable coupling 253, and that the housing 308 of that tiltable coupling was oriented to have that piston at the top thereof. Also at such time, the electrolyte within the sensor 106 will be immersing more of the length of one of the electrodes of that sensor than it will be immersing of the length of the other of the electrodes of that sensor; and hence the sensing circuit, to which the sensors 100, 102, 104 and 106 are connected, could respond to that sensor to indicate an out-of-balance condition. If that indication signified that the axis of the piston 326 was lying in a vertical plane which passed through the axis of the tiltable coupling 253, and that the axis of that sensor was displaced from true vertical by 35°, that indication would signify that the axis of that tiltable coupling was horizontal.

If the tiltable couplong 253 is oriented to have the axis of the piston 326 truly horizontal and to dispose the piston 326 at the left-hand side of the housing 308 in FIG. 9, and if the axis of that tiltable coupling is truly horizontal, the axis of the sensor 100 will be truly vertical and the electrodes of that sensor will be directed upwardly. At such time, the electrolyte within that sensor will be immersing the same lengths of all of the electrodes in that sensor, and hence the sensing circuit, to which the sensors 100, 102, 104 and 106 are connected, could respond to that sensor to indicate a null condition. Such an indication would signify that the axis of the piston 326 was lying in a horizontal plane and that the said piston was at the left-hand side of the housing 308 in FIG. 9. On the other hand, if the tiltable coupling 253 is oriented to have the axis of the piston 326 truly horizontal and to dispose the piston 326 at the right-hand side of the housing 308 in FIG. 9, and if the axis of that tiltable coupling is truly horizontal, the axis of the sensor 104 will be truly vertical and the electrodes of that sensor will be directed downwardly. At such time, the electrolyte within that sensor will be immersing the same lengths of all of the electrodes in that sensor; and hence the sensing circuit, to which the sensors 100, 102, 104 and 106 are connected could respond to that sensor to indicate a null condition. Such an indication would signify that the axis of the piston 326 was lying in a horizontal plane and that the said piston was at the right-hand side of the housing 308. It thus should be apparent that the sensors 100, 102, 104 and 106 can supply signals to the sensing circuit, to which those sensors are connected, which can signify when the tiltable coupling 253 has the axis thereof lying in a horizontal plane and has the piston 326 at the top of the housing 308, which can signify when the tiltable coupling has the piston 326 at the left-hand side of the housing 308 with its axis truly horizontal, and which can signify when that tiltable coupling has the piston 326 at the right-hand side of the housing 308 with its axis truly horizontal.

The sensor 100 can supply signals to the sensing circuit to which it is connected even if the axis of the sensor is caused to deviate from true vertical as much as 45° in either direction, and hence that sensor can be used to supply signals which will indicate circumferential rotation of the tiltable coupling 253 of as much as 45° in either direction from a position which is displaced 90° in the clockwise direction from the position shown by FIGS. 8–16. Similarly, the sensor 104 can supply signals to the sensing circuit to which it is connected even if the axis of that sensor is caused to deviate from true vertical as must as 45° in either direction, and hence that sensor can be used to supply signals which will indicate circumferential rotation of the tiltable coupling 253 of as must as 45° in either direction from a position which is displaced 90° in the counter clockwise direction from the position shown by FIGS. 8–16. As a result, the sensor 104 can be used to indicate the orientation of the tiltable coupling 253 prior to, and during, the time that tiltable coupling is used to cause the down-hole drill 251 to drill a curved section of a hole which curves to the right in a plane that inclines upwardly from true horizontal at an angle of 45°, that inclines downwardly from true horizontal at an angle of 45°, or that has any desired inclination between the inclinations of those two planes. Similarly, the sensor 100 can be used to indicate the orientation of the tiltable coupling 253 prior to, and during, the time that tiltable coupling is used to cause the down-hole drill 251 to drill a curved section of a hole which curves to the left in a plane that inclines upwardly from true horizontal at an angle of 45°, that inclines downardly from true horizontal at an angle of 45°, or that has any desired inclination between the inclinations of those two planes.

The sensor 102 can supply signals to the sensing circuit to which it is connected even if the tiltable coupling 253 is rotated 45° in either direction from the position shown by FIGS. 8–16; and hence that sensor can be used to supply signals which will indicate circumferential rotation of the tiltable coupling 253 of as much as 45° in either direction from that position. The sensor 106 can supply signals to the sensing circuit to which is is connected even if the longitudinal axis of the tiltable coupling is rotated as much as 10° in the clockwise direction from the position shown in FIGS. 5A and 5B or is rotated as much as 80° in the counter clockwise direction from that position. As a result, that sensor can be used to supply signals which will indicate, with a high degree of precision, any clockwise or counter clockwise rotation of the longitudinal axis of the tiltable coupling 253 of as much as 10° from the position shown by FIGS. 5A and 5B; and that sensor also can be used to supply signals which will indicate any counter clockwise rotation of the longitudinal axis of that tiltable coupling of between 10° and 80° from that position.

If desired, the clip 444 for the sensor 106 could be set so the axis of that sensor inclined away from the plane of the annular support 446 at an angle of 125°. In that event, that sensor could be used to supply signals to the sensing circuit to which it was connected even if the longitudinal axis of the tiltable coupling 253 was rotated as much as ten degrees in the counter clockwise direction from the position shown in FIGS. 5A and 5B or was rotated as much as 80° in the clockwise direction from that position. As a result, that sensor could, if so mounted on the annular support 446, be used to supply signals which would indicate, with a high degree of precision, any clockwise or counter clockwise rotation of the longitudinal axis of the tiltable coupling 253 of as much as 10° from the position shown by FIGS. 5A and 5B; and that sensor also could be used to supply signals which would indicate any clockwise rotation of the longtudinal axis of that tiltable coupling of between 10 and 80° from that position.

In the readout 468 for the preferred embodiment of the present invention, the needle of the meter will respond to a voltage of 10 volts to move past digits representing a count of 500. This is desirable, because it means that each digit represents two hundredths of a volt.

Although just four sensors have been shown in the tiltable coupling 253, more sensors could be added if it ever became desirable to do so. However, because most users of drilling equipment customarily drill in, or in search of, desired material which has the same general orientation within subterranean formations, it will usually be sufficient to equip any given tiltable coupling with four sensors that are mounted on the annular support 446 in such a way as to provide the orientation information for one general type of orientation of desired material in a subterranean formation. Thus, one tiltable coupling 253 might be equipped with sensors 100, 102, 104 and 106 which were mounted on the annular support 446 so they could guide the orientation of the piston 326 when "underhand" curved sections were to be drilled, and another tiltable coupling might be equipped with sensors which were mounted on that annular support so they could guide the orientation of that piston when "overhand" curved sections were to be drilled. Further a third tiltable coupling might be equipped with sensors which were mounted on that annular support so they could guide the orientation of that piston when upwardly-directed vertical sections were to be drilled, and a fourth tiltable coupling might be equipped with sensors which were mounted on that annular support so they could guide the orientation of that piston when downwardly-directed vertical sections were to be drilled. In each of those tiltable couplings, at least one of the sensors should be mounted to indicate any deviations of the axis of the section of hole from true vertical.

A pipe Tee 448 and a 90° pipe ell 450 connect the other end of the length 341 of air pressure hose to the length 437 of medium pressure hose, as shown by FIG. 4. That pipe Tee and that pipe ell coact with the length 341 of air pressure hose, with the swivel nut 348, and with the pipe fitting 346 to enable the conductors for the sensors 100, 102, 104 and 106 to extend into a long air pressure hose 452 while maintaining the air-tight integrity of that long air pressure hose and of the length 437 of air pressure hose. The air pressure hose 452 extends from the pipe Tee 448 to and through a collar 454 which is disposed within the outer end of the hole 456 that is being formed by the down-hole drill 251. The outer end of the long air pressure hose 452 is wound upon a reel 460 and is connected to a further pipe Tee 462. A pipe fitting 464 is connected to the pipe Tee 462; and the cable 466, which includes the conductors for the sensors 100, 102, 104 and 106, extends outwardly through, but is hermetically sealed to, that pipe fitting. That cable extends to the readout 468, as indicated by FIG. 4; and that readout can include an A.C. version of the circuitry shown in U.S. Pat. No. 3,571,937. The pipe fitting 464 and the pipe Tee 462 coact with the pipe Tee 448, with the pipe fitting 450, with the length 341 of medium pressure hose, with the swivel nut 348, with the pipe fitting 346, with the pipe fitting 438, with the swivel nut 436, with the length 437 of air pressure hose, and with the long medium pressure hose 452 to permit the calbe 466 to enter the long medium pressure hose, to remain within that long air pressure hose, and to exit from that long medium pressure hose while maintaining the air-tight integrity of that long air pressure hose and of those lengths of air pressure hose. The numeral 470 denotes a manually-operable stop and waste valve which is connected to the outer end of the long air pressure hose 452; and that valve is connected to a source of compressed air, not shown, by a hose 472. In its open position, that valve will connect the source of compressed air to the pipe Tee 462; and in its closed position, that valve will disconnect that source of compressed air from that pipe Tee and will vent the compressed air within the long air pressure hose 452.

The numeral 455 denotes an arm which extends downwardly from the collar 454; and a large diameter hose 474 extends downwardly from that arm to a dust sample collector 234 which can be identified to the identically-numbered dust sample collector which is shown in said application Ser. No. 219,813. The numeral 185 in FIG. 4 denotes a standard and usual clamp which can grip the section 458 of drill rod; and that clamp can hold that section of drill rod against undesired rotation. The numeral 186 denotes a jack which is disposed within a working, not shown, and which has the upper end thereof abutting the ceiling of that working and which has the lower end thereof abutting a plate 189 that rests on the floor of that working. That jack will be lengthened until the upper end thereof bears so solidly against the ceiling of the working that it is fixedly held against shifting relative to that working.

The numeral 190 denotes a mounting frame which is secured to the jack 186 adjacent the upper end of that jack. A pneumatic cylinder 192 is supported by the mounting frame 190; and a piston rod 194 has one end thereof secured to the piston within that cylinder, and has the other end thereof extending outwardly of that cylinder and is secured to the clamp 185 so that clamp and that piston rod will reciprocate as a unit. The pneumatic cylinder 192 is a double-acting cylinder; and thus can cause the piston rod 194 to force the clamp 185 to move toward and away from the hole 456. The numeral 196 denotes an air distributor which has a handle 198; and that handle can be adjusted to control the flow of compressed air to the pneumatic cylinder 192 via a hose 233. The nummeral 202 denotes a further handle which can be adjusted to control the flow of compressed air to the section 458 of drill rod via hose 203. A hose 205 connects the air distributor 196 to the source, not shown, of compressed air to which the hose 472 is connected. A pressure regulating valve, not shown, will be interposed between the hose 472 and that source of compressed air; and a further pressure regulating valve, not shown, will be interposed between the hose 205 and that source of compressed air. The pressures on the compressed air supplied to the hoses 205 and 472 should be set so the pressure on the air which passes through the passages 345 and 347 to enter the recess 314 in the housing 308 is essentially the same as the pressure on the air which is supplied to the inlet port 315. A pressure of about 100 pounds per square inch should be a usable pressure on the air which enters the recess 314.

The numeral 204 denotes a supporting bracket which is mounted on the jack 186 below the level of the mounting frame 190. That supporting bracket slidably holds the drill rod section 458 while acting to confine that drill rod section against radially-directed movement; and, as shown by FIG. 4, that drill rod section passes through the clamp 185. The outer end of the drill rod section 458 is connected to the hose 203 by a connector 211 which can permit rotation of that drill rod section with a corresponding rotation of that hose.

A line oiler, not shown, will be connected to the house 205; and a water pump, not shown, also will be connected to that hose. That line oiler and that water pump could be essentially the same — in structure and operation — as the line oiler and water pump in said application Ser. No. 219,813.

In using the tiltable coupling 253 of FIGS. 5A and 5B, the protuberance 358 or the protuberance 360 on the fulcrum 346 will be set so it is displaced 180° from the roller 328 which is supported by the piston 326. To move the protuberance 358 from the position of FIG. 5A to the desired position, the operator of the drilling equipment will remove the pin 381, will remove the stop 378, will rotate the fulcrum 356 180°, will re-insert that stop, and will re-insert that pin. At such time, the protuberance 358 on that fulcrum will be displaced 180° from the roller 328; and the protuberance 360 will be displaced 90° in the clockwise direction from that roller, as the latter protuberance is viewed in FIG. 14. To move the protuberance 360 from the position of FIG. 14 to a position which is displaced 180° from the roller 328, the operator of the drilling equipment will remove the pin 381, will remove the stop 378, will rotate the fulcrum 356 90° in the counter clockwise direction in FIG. 14, will re-insert that stop, and will re-insert that pin. At such time, the protuberance 360 on that fulcrum will be displaced 180° from the roller 328; and the protuberance 358 will be displaced 90° in the counter clockwise direction from that roller, as the latter protuberance is viewed in FIG. 14. The protuberance 358 will be displaced 180° from the roller 328 whenever the tiltable coupling 253 is to be used to cause the down-hole drill 251 to drill a curved section which curves to the left; whereas the protuberance 360 will be displaced 180° from the roller 328 whenever the tiltable coupling 253 is to be used to cause the down-hole drill 251 to drill a curved section which curves to the right.

The external thread 268 on the left-hand end of the rotatable element 264 will be threaded into the internal thread 262 in the right-hand end of the down-hole drill 251, the tubular projection 307 at the right-hand end of the housing 308 will be threaded onto the section 352 of drill rod, and the electrical connector 349 will be connected to the complementary connector which is held by the swivel nut 358. That swivel nut will be tightened on the pipe fitting 346, the swivel nut 436 will be tightened on the pipe fitting 438, the left-hand end of the long medium pressure hose 452 will be passed through the collar 454 and securely fastened to the pipe Tee 448, and the lengths 341 and 437 of medium pressure hose will be securely fastened to that pipe Tee; and then the down-hole drill 251, the tiltable coupling 253, and the section 352 of drill rod will be introduced into a previously-drilled, short length hole 456. The collar 454 will be telescoped over the rear end of the section 352 of drill rod and will then be forced into the outer end of the hole 456 to effectively seal that outer end. The hose 474 will be connected to the arm 455 and also the dust sample collector 234.

If the initial portion of the hole 456 is to be straight, the valve 470 will be left in closed position; and hence the spring 320 in FIG. 5B will hold the cup-shaped valve 318 in position to block the outlet port 317 of the chamber 316. As a result, the compressed air which passes through hose 205, air distributor 196, hose 203, connector 211, section 458 and section 352 of drill rod, tubular projection 307 of housing 308, and passages 345 and 347 in that housing to reach the recess 314 will be unable to enter and to pass through the chamber 316. This means that no air pressure will be applied to the pistons 326 and 332; and hence those pistons will be urged toward each other by the spring 340. The roller 334 will be in the position shown by FIG. 5B; but the roller 328 will project outwardly from the protuberance 311 a distance which is close to the value of the radius of that roller. The operator of the drilling equipment will set those pistons in those positions before the tiltable coupling 253 is telescoped into the hole 456; and those pistons will remain in those positions until the valve 470 is opened. The down-hole drill 251 and the tiltable coupling 253 will be urged inwardly of the hole 456 by the piston rod 194 and the clamp 185; and the air which is supplied to the recess 314 will, in part, pass through the passages 430 and 431 to enter the vane-type air motor and will, in part, pass through the hollow rotor 416 of that air motor, through the center of the eccentric sleeve 380, and through the center of the rotatable element 264 to the inlet port of that down-hole drill. The air which enters the vane-type air motor will act upon the vanes 424 to cause those vanes to rotate the rotor 416 in the counter clockwise direction in FIG. 10. The pin 422 and the resilient washers 408 and 410 will cause the hollow gear 388 to respond to that rotation to cause the roller 386 to rotate the rotatable element 264 in the clockwise direction in FIG. 13 at one-thirtieth the rate at which the rotor 416 rotates. That rotatable element will rotate the down-hole drill 251 at the one-thirtieth rate; and the 30-to-1 reduction in the speed of that rotatable element 264 relative to the speed of the rotor 416 provides a 30-to-1 increase in torque. As a result, the vane-type air motor is able to force the down-hole drill 251 to slowly rotate within the hole 456. The air which enters the inlet port of the down-hole drill 251 will cause that down-hole drill to act against the inner end of the hole 456 in the manner in which the pneumatic hammer drives its bit against a surface; and hence that down-hole drill will progressively deepen that hole. As long as the valve 470 is left closed, neither the roller 328 nor the protuberance 358 will be forced into solid engagement with the inner surface of the hole 456; and, similarly, the bearing point 309 will not be forced into solid engagement with the inner surface of that hole. Consequently, as long as the valve 470 is left closed, the down-hole drill 251 will deepen the hole 456 along a substantially straight axis.

Whenever it is desirable to drill a curved section of a hole — whether that section is to be the initial, an intermediate, or the final section of that hole — the tiltable coupling 253 will be set so the axis of the piston 326 lies in the plane in which the curved section will lie, so the roller 328 will face the geometric center of the desired curve while the protuberance 358 or the protuberance 360 will face away from that geometric center, and so the protuberances 358 and 360 will be in positions wherein they will bear the horizontal and vertical components of force which will be applied to the front end of that tiltable coupling. To give the tiltable coupling 253 the desired circumferential positioning, a suitable wrench will be used to apply circumferentially-directed forces to the section of drill rod which is held by the clamp 185 and the bracket 204. The meter and switches of the readout 468 will be used to check the attitudes and orientations of the appropriate sensors; and that meter, those switches and those sensors will make it possible to fix the desired circumferential position of the tiltable coupling 253 within 4 minutes of a degree. That meter and those switches will correspond to the meter and switches in U.S. Pat. No. 3, 3,571,937.

Once the tiltable coupling has been given the desired orientation, the valve 470 will be opened; and, thereupon, compressed air will flow into the chamber 324 and into the bypass 319. The compressed air in the chamber 324 will act upon the pistons 326 and 332 and will tend to force those pistons to move outwardly relative to the housing 308; and, almost immediately, the spring 340 will yield sufficiently to permit the rollers 328 and 334 to move outwardly relative to that housing. The roller 328 will move outwardly toward the position shown by FIG. 5B, and the roller 332 will move outwardly from the position shown by FIG. 5B; and, very promptly, those rollers will move into engagement with the inner surface of the hole 456. The forces of which those rollers apply to that inner surface will be great enough to prevent undesired rotation of the tiltable coupling 253 relative to that hole.

Then, when air is introduced into the drull rod string and the air motor starts to rotate and the down-hole drill begins drilling, the orientation of the selected plane of curvature indicated by the sensors will be maintained.

The piston 326 has a larger cross-sectional area than does the piston 332, and hence the total force which the compressed air applies to the piston 326 will be greater than the total force which that compressed air applies to the piston 332. The piston 326 will respond to that greater total force to tend to move outwardly toward the pin 342 — even though such movement may require the piston 332 to move back inwardly toward the position shown by FIG. 5B. The piston 326 will continue to move outwardly toward the pin 342 until the bearing point 309 is solidly in engagement with one side of the hole 456, until the protuberance 358 or 360 on the fulcrum 356 also is solidly in engagement with that side of that hole, and until the roller 328 is solidly in engagement with the opposite side of that hole. Those solid engagements should be attained before the down-hole drill 251 has deepened the hole by another 20 feet; and those solid engagement will effectively establish a three-point engagement between the tiltable coupling 253 and the inner surface of the hole 456. That three-point engagement will force the axis of the tiltable coupling, and hence the axis of the down-hole drill 251, to shift relative to the axis of that portion of that hole in which that tiltable coupling is located.

Because the protuberance 358 or 360 will project a finite distance radially outwardly beyond the bearing point 309, the axis of the tiltable coupling 253 will incline from lower right to upper left in FIGS. 5A and 5B. Consequently, the down-hole drill 251 will start to form a curved section of the hole 456 which will curve upwardly from lower right to upper left. The radius of curvature of that curved section of that hole will be a function of the relative radial positions of the bearing point 309 and of the protuberance 358 or 360. The tiltable coupling 253 will not immediately assume the fully-inclined position which is determined by the difference between the radial positions of the bearing point 309 and of the protuberance 358 or 360; because of the inner end of the hole 456 will prevent immediate lateral shifting of the front end of the down-hole drill 251. However, that down-hole drill will apply a substantial lateral, as well as a substantial axial, cutting force to the inner end of the hole 456; and hence the radius of the curved section of that hole will decrease progressively from the time the down-hole drill 251 starts drilling at an angle to the portion of the hole in which the tiltable coupling 253 is located until the roller 328, the bearing point 309 and the protuberance 358 or 360 move into solid engagement with the inner surface of the hole 456. Thereafter, as long as the valve 470 is left open, the curvature of that curved section of the hole 456 will be constant.

As the pressure on the compressed air which enters the bypass 319 builds up, that compressed air will apply sufficient force to the closed end of the cup-shaped valve 318 to overcome the force which is exerted by the spring 320. Thereupon, that cup-shaped valve will move toward the closure 322; and, thereupon, that valve will open the inlet and outlet ports 315 and 317, respectively. The air which flows through those ports will combine with the air that flows through the passages 345 and 347 to cause the down-hole drill 251 to continue to deepen the hole 456 and to cause the air motor to continue to rotate that down-hole drill.

To change the radius of the curved section of the hole, it is only necessary to withdraw the various sections of drill rod, the tiltable coupling 253 and the down-hole drill 251 from the hole 456, to remove the fulcrum 256, and to substitute a fulcrum which has a different radial dimension for the protuberances 358 and 360. If a fulcrum was selected which had radial dimensions for the protuberances 358 and 360 that were smaller than the radial dimensions of the protuberances 358 and 360 on the fulcrum 356, the down-hole drill 251 would form a curved section for the hole 456 which had a larger radius than would any curved section that was formed when the fulcrum 356 was used. On the other hand, if a fulcrum was selected which had radial dimensions for the protuberances 358 and 360 that were larger than the radial dimensions of the protuberances 358 and 360 on the fulcrum 356, the down-hole drill 251 would form a curved section for the hole 456 which had a smaller radius than any curved section that was formed when the fulcrum 356 was used. The practical minimum radius of a curved section of a hole, which can be drilled by the combination of the down-hole drill 251 and of the tiltable coupling 253, probably is between 100 and 125 feet.

Figure 13:
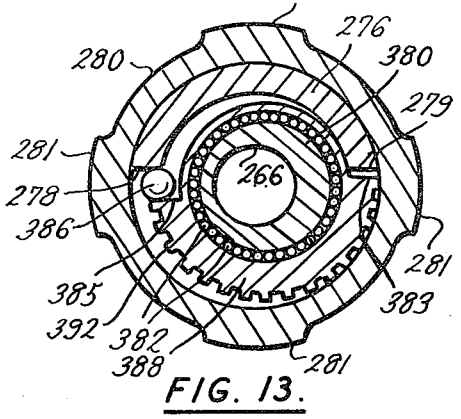
FIG. 13 is a sectional view through the front end of the tiltable coupling of FIG. 4, and it is taken along the plane indicated by the line 13—13 in FIG. 5A.

As the vane-type air motor rotates the eccentric sleeve 380, and thus causes rotation of the rotatable element 264 in the clockwise direction in FIG. 13, the down-hole drill 251 will rotate with that rotatable element. However, that down-hole drill will apply reaction forces to the tiltable coupling 253 which will tend to rotate that tiltable coupling in the counterclockwise direction in FIG. 13. Any unscheduled rotation of that tiltable coupling would be objectionable, because it would cause the sensors to indicate a change of direction of the hole 456 which had not, in fact, occurred; and hence it is important to keep the reaction forces which are developed by the down-hole drill 251 from rotating the tiltable coupling 253. The present invention prevents such rotation of that tiltable coupling by forcing the rollers 328 and 332 into extremely tight engagement with the inner surface of the hole 456. In addition, the present invention provides pitches for the turns of the threads 330 and 336 on the rollers 328 and 334 which will enable those rollers to apply balancing clockwise forces to that tiltable coupling. Specifically, the pitches of the threads 330 and 336 incline the turns of those threads at angles to the longitudinal axis of the tiltable coupling 253 which enable those threads to respond to their engagements with the inner surface of the hole 456, as that tiltable coupling moves ever deeper into that hole, to apply clockwise forces to that tiltable coupling which tend to balance the reaction forces that the down-hole drill 251 applies to that tiltable coupling. This means that the rollers 328 and 334 not only keep the tiltable coupling 253 properly oriented relative to the hole 456 but also progressively compensate for the continued reaction forces which are developed by the down-hole drill 251. If desired, the slot in the outer end of each of the pistons 326 and 332 could be set at an angle to the longitudinal axis of the tiltable coupling 253 so the rollers 328 and 334 would respond to movement of that tiltable coupling inwardly of the hole to tend to apply counter clockwise forces to that tiltable coupling. In such event, annular ribs or ridges, rather than threads, could be provided on the peripheries of those rollers.

As the down-hole drill 251 progressively deepens the hole 456, it will form a dust; and, whether that dust will consist of the desired material, of the material of the subterranean formation, or a mixture of those materials, that dust will be carried back through that hole to the collar 454 by the air which is released by that down-hole drill at the end of each stroke. The air which escapes from the outlet port 407 of the air motor also will help carry that dust to that collar; and, as that dust reaches that collar, it will be forced to pass downwardly through arm 455 and hose 474 in to the dust sample separation 234. That dust will be held by that dust sample separator, but the air will be released into the working.

Figure 6:
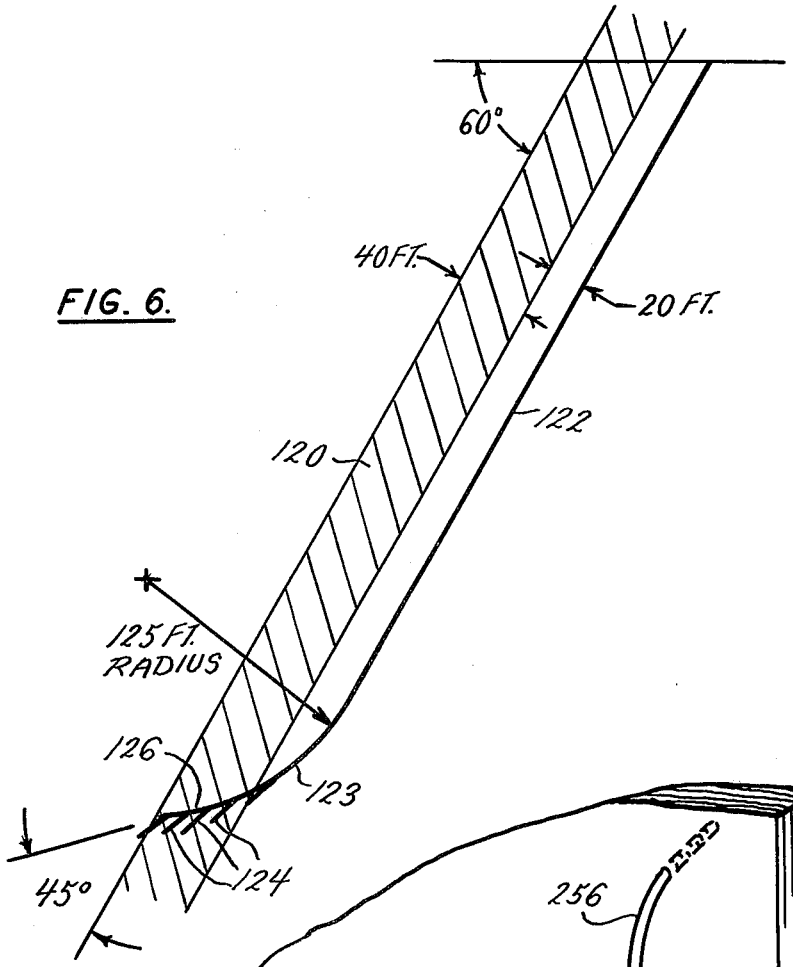
FIG. 6 is a sectional view through a vein which inclines downwardly through a subterranean formation, and it shows the elongated straight section of a hole which has been drilled to the right of that vein and it also shows the bottom of that hole plus fingers which extend downwardly from that bottom into that vein.

Referring particularly to FIG. 6, the numeral 120 denotes a vein of desired material which inclines downwardly and to the left through a subterranean formation at an angle of approximately 60°; and an elongated hole extends parallel to that vein. That hole is shown with a straight section 122 of about 380 feet in length; and that straight section is shown approximately 20 feet to the right of that vein. That vein is shown as being 40 feet wide; and it continues downwardly beyond the lower end of the hole. The lower end of that hole has a curved section 123 and a curved section 126; and the curved section 123 is shown as having a length of approximately 65 feet, while the curved section 126 is shown as having a length of approximately 76 feet. Both curved sections have a radius of approximately 125 feet; and the curved section 123 curves toward the vain 120; and the curved section 126 passes through that vein at an angle of approximately 45°. The numeral 124 denotes a number of short "fingers " that are drilled at an angle to the curved section 126 of the hole; and each of those fingers will preferably be about 8 feet long. The fingers 124 preferably will be formed by a diamond-equipped core-type drill.

The straight section 122, the curved section 123, and the curved section 126 of the hole in FIG. 6 preferably will be drilled by the down-hole drill 251 in FIG. 4; and that down-hole drill can be the type shown in U.S. Pat. No. 3,084,683 or U.S. Pat. No. 3,361,219. The rear end of that down-hole drill will be supported by the tiltable coupling 253 which is shown in perspective in FIG. 4 and which is shown in section in FIGS. 5A and 5B. The short fingers 124 preferably will be drilled by a diamond-equipped core-type drill which is designed to use compressed air as the rotating force, and as the dust-removing medium, therefor. The fingers 124 will not be drilled until after the straight section 122 and substantially all of the curved section 123 have been drilled by the down-hole drill 251. Specifically, the straight section 122, and the major portion of the length of the curved section 123 will be drilled by the down-hold drill 251; and then the drill rod string, the tiltable coupling 253 and that down-hole drill will be removed from the hole. The tiltable coupling 253 will be disconnected from the drill rod string, and then a substitute tiltable coupling will be connected to that drill and string; and that tiltable coupling can be identical to the tiltable coupling 253 except that it will have an external thread 268 on the rotatable element 264 thereof which can mate with the internal head of a diamond-equipped core-type drill, and it will have a perforated disc mounted within the reduced-diameter right-hand end 426 of the rotor 416 of the vane-type air motor. That disc will serve as an expansion orifice for the compressed air, and thus will permit the resulting expanded air to be relatively cool by the time it has passed through that rotor, through the rotatable element 264, and through the full length of the diamond-equipped core-type drill. A diamond-equipped core-type drill will be connected to the substitute tiltable coupling and then that diamond-equipped core-type drill and its tiltable coupling will be telescoped downwardly through the sections 122 and 123 of the hole. The axis of that diamond-equipped core-type drill will be kept essentially coaxial with the axis if the straight section 122 by leaving the valve 470 closed while that diamond-equipped core-type drill is being moved downwardly through that straight section. The axis of that diamond-equipped core-type drill will be kept essentially coaxial with the axis of the curved section 123 by disposing the roller 328 so it confronts the smaller radius surface of that curved section, by disposing the protuberance 358 or 360 so it confronts the larger radius surface of that curved section, and by opening the valve 470. By keeping the axis of that diamond-equipped, core-type drill essentially coaxial with the axes of the straight and curved sections 122 and 123, respectively, it is possible to virtually eliminate any possibility of the tip of that diamond-equipped, core-type drill engaging, and jamming against, the inner surface of either of those sections as that diamond-equipped, core-type drill is moved downwardly through these sections.

At the time the tip of the diamond-equipped, core-type drill approaches the inner end of the curved section 123 of the hole, the valve 470 can be closed; and, thereupon, the compressed air, which forced the roller 328 into engagement with the smaller radius surface of that curved section and which forced the protuberance 358 or 360 into engagement with the larger radius surface of that curved section, will be vented into the working. The weight of the diamond-equipped, core-type drill will cause the tip of that drill to move downwardly into the apex of the angle defined by the inner end and the larger radius surface of the curved section 123; and the application of compressed air to the hose 205 in FIG. 4 will cause the vane-type air motor within the substitute tiltable coupling to rotate the diamond-equipped, core-type drill, and will cause the piston rod 194 and clamp 185 to press the tip of that diamond-equipped, core-type drill into that apex of that angle.

After the right-handmost finger 124 has been drilled, the drill rod string, the diamond-equipped, core-type drill, and the substitute tiltable coupling will be removed from the hole; and that tiltable coupling will be disconnected from that drill rod string. The down-hole drill 251 and its tiltable coupling 253 will be re-connected to the drill rod string; and that down-hole drill and that tiltable coupling will be re-inserted within the hole. That down-hole drill will then be used to drill the portion of the hole which lies between the upper end of the right-handmost finger 124 and the point where the second right-handmost finger 124 is to be drilled. Thereupon, that down-hole drill and its tiltable coupling and the drill rod string will again be removed from the hole; and that down-hole drill and its tiltable tiltable coupling will again be replaced by the diamond-equipped core-type drill and the substitute tiltable coupling. At such time, that diamond-equipped, core-type drill and that substitute tiltable coupling will again be inserted in the hole and that diamond-equipped core-type drill will be used to drill the second right-handmost finger 124. The alternate uses of the down-hole drill 251 and of the diamond-equipped core-type drill will permit the rest of the curved section 126 of the hole and the rest of the fingers 124 to be drilled. In each instance, the finger 124 will be drilled by the diamond-equipped core-type drill before the portion of the curved section 126 which is in register with that finger will be drilled by the down-hole drill 251. Because the down-hole drill 251 will be used to drill the straight section 122, the curved section 123, and the curved section 126 of the hole, the diamond-equipped core-type drill will be relieved of the need of doing that drilling. Consequently, that diamond-equipped core-type drill will experience minimum wear; and that diamond-equipped, core-type drill can be operated without requiring a liquid to cool it. If desired, the section 126 of the hole could be straight, and that section could be given any desired inclination.

The substitute tiltable coupling preferably will have a hollow gear 388 which has 28, rather than 29, teeth 392 thereon. Such a hollow gear will provide only a 15-to-1 reduction in speed, and thus will cause the diamond-equipped core-type drill to rotate at twice the speed at which the down-hole drill 251 is rotated. The resulting doubling of the speed of rotation of the diamond-equipped core-type drill is desirable; because such a drill is a rotary-type, rather than a percussive-type, of drill. The resulting halving of the torque multiplication is acceptable; because the diameter of the diamond-equipped, core-type drill is considerably less than the 4 inch diameter of the down-hole drill 251.

Each of the fingers 124 will have the axis thereof lying very close to the axis of the adjacent portion of section 123 or 126. Specifically, the axis of each finger 124 will be displaced from the axis of the adjacent portion of that hole by an angle of only 1½°. Consequently, it should be recognized that the angles indicated by FIG. 6 are not representative of the actual angular displacement between the axes of the fingers 124 and of the adjacent portions of the hole. Those angles had to be grossly exaggerated in FIG. 6, because angles of 1½° could not have been shown on the small scale used in making FIG. 6.

Figure 7:
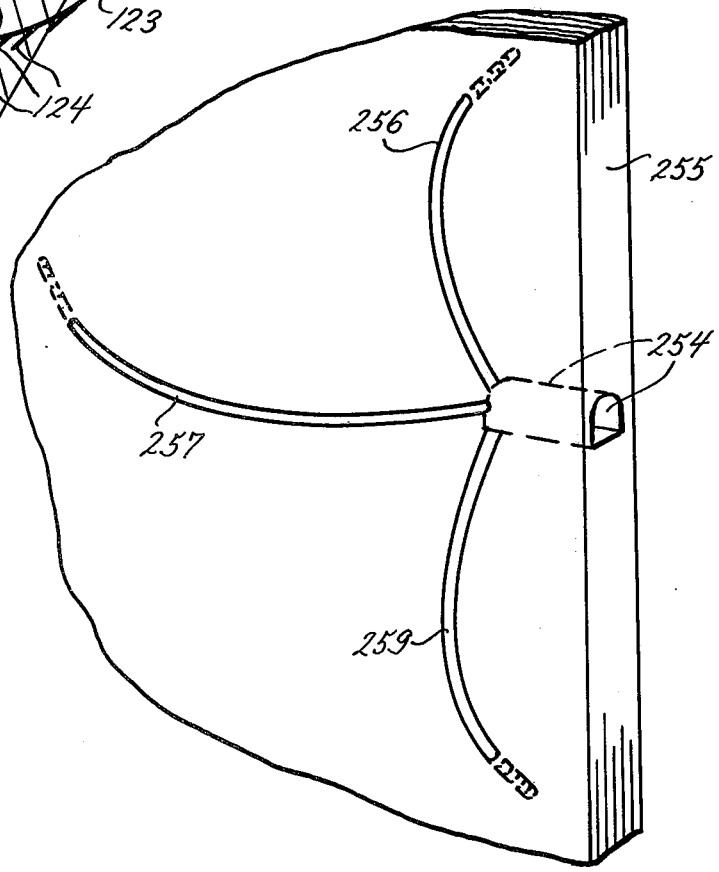
FIG. 7 is a perspective view which shows a number of curved holes that have been drilled from a working within a vein to points that are displaced forwardly, upwardly and downwardly from that working.

Referring to FIG. 7, the numeral 254 denotes a working within a vein 255 which is vertically directed within a subterranean formation. The numeral 256 denotes a curved hole which extends outwardly and upwardly from the working 254 into the surrounding subterranean formation and then curves back into the vein 255. The numeral 257 denotes a further curved hole which extends outwardly from the working 254 into the surrounding subterranean formation and then curves back into the vein 255. The numeral 259 denotes a further curved hole which extends outwardly and downwardly from the working 254 into the surrounding subterranean formation and then curves back into the vein 255. The curved holes 256 and 259 are shown as lying in the same vertical plane; but those holes could be drilled in different planes, and those planes could be inclined at different angles to the vertical. The curved hole 257 is shown as lying in a horizontal plane, but that hole could be drilled in different planes, and those planes could be inclined at different angles to the horizontal. The holes 256, 257 and 259 can be formed by the down-hole drill 251 and the tiltable coupling 253 shown in FIG. 4 — when that tiltable coupling is provided with appropriately-mounted sensors 100, 102, 104 and 106. The curved hole 257 and the curved hole 256 could be drilled while the down-hole drill 251 was connected to a tiltable coupling 253 which had those sensors mounted on the annular support 446 in the manner shown by FIGS. 15 and 16. The curved hole 259 could be drilled while the down-hole drill 251 was connected to a tiltable coupling which had the sensor 106 thereof oriented so its axis was parallel to the axis of that tiltable coupling and so its pointed end was directed away from the down-hole drill 251.

To drill the curved hole 256 in FIG. 7, the tiltable coupling 253 will be set so the roller 328 will engage the smaller-radius side of that hole and so the protuberance 358 and the bearing point 309 will engage the opposite side of that hole. When the hole 257 in FIG. 7 is to be drilled, the tiltable coupling 253 will be set so the roller 328 engages the smaller-radius side of that hole, so the protuberance 360 and the bearing point 309 engage the larger-radius side of that hole, and so the protuberance 358 rests on the bottom of that hole. When the hole 259 in FIG. 7 is to be drilled, the tiltable coupling 253 will be set so the roller 328 engages the smaller-radius side of that hole, so the protuberance 358 and the bearing point 309 engage the larger-radius side of that hole, and so the down-hole drill 251 is directed downwardly rather than upwardly.

It should be noted that whenever the tiltable coupling 253 is being used to cause the down-hole drill 251 to drill a curved section of a hole, the long air pressure hose 452 will not only supply the air which is needed to move the pistons 326 and 332 outwardly relative to the housing 308, but also will supply an appreciable portion of the air which is needed to operate the vane-type air motor and to cause the down-hole drill 251 to deepen that hole.

By using an auxiliary air pressure hose to help the drill rod string supply air to operate the vane-type air motor and to actuate the down-hole drill 251, the present invention provides an increased air-conducting cross-section which minimizes frictional air pressure losses while utilizing a relatively flexible rod string which can easily bend in the curved portions of the hole.

Because compressed air will flow through the long air pressure hose 452 only when the tiltable coupling 253 is being used to cause the down-hole drill 251 to form a curved section of a hole, the pressure on the air which is applied to the drill rod string must be increased whenever that down-hole drill is being used to drill a straight section of a hole. However, the reductions in frictional losses, which can be attained when the tiltable coupling 253 is causing the down-hole drill 251 to form curved sections of the hole, are important enough to make it worthwhile to be able to use the long air pressure hose 452 to supply part of the air which is required by the vane-type air motor and by that down-hole drill.

Referring particularly to FIG. 18, the numeral 480 generally denoted a drilling rig which will be equipped with a mounting frame 190, a cylinder 192, a piston rod 194, a clamp 185, an air distributor 196, handles 198 and 202, a hose 203, a connector 211, a reel 460, a collar 454, an arm 455, a dust separator 234, a hose 472, and a readout 468 or the equivalents of those various elements. That drilling rig preferably will be made so it can be operated at ground level, and thus preferably will be made so it can withstand wind, rain, snow, and the other elements of the weather.

The numeral 482 denotes a straight, downwardly-inclined section of a hole, the numeral 484 denotes a curved section which is contiguous with the lower end of the straight section 482, the numeral 486 denotes an elongated, horizontally-extending straight section which is contiguous with the lower end of the curved section 484, the numeral 488 denotes a further horizontally-directed straight section which branches off from the horizontally-directed straight section 486 at a curved section 487, and the numeral 490 denotes a still further horizontally-directed straight section which branches off from the horizontally-directed straight section 486 at a curved section 489. These various sections can be drilled by using the tiltable coupling 253 to orient and guide the down-hole drill 251.

Specifically, the straight section 482 will be drilled while the valve 470 is closed; and the curved section 484 will be drilled while the valve 470 is open and while the roller 328 is abutting the smaller-radius face of that curved section and the protuberance 358 and the bearing point 309 are engaging the larger-radius face of that curved section. The horizontally-directed straight sections 486, 488 and 490 will be drilled while the valve 470 is closed, the curved section 487 will be drilled while the valve 470 is open, while the roller 328 is abutting the smaller-radius face of that curved section, while the protuberance 358 and the bearing point 309 are engaging the larger-radius face of that curved section, and while the protuberance 360 is resting on the bottom of that curved section, and the curved section 489 will be drilled while the valve 470 is open, while the roller 328 is abutting the smaller-radius side of that curved section, while the protuberance 360 and the bearing point 309 are engaging the large-radius side of that curved section, and while the protuberance 358 is resting on the bottom of that curved section.

It is important to note that the sensors 100, 102, 104 and 106 are directly incorporated into the tiltable coupling 253, and that those sensors are rugged enought to withstand the vibration and shock to which that tiltable coupling is subjected while the down-hole drill 251 is lengthening the hole 456. Those sensors and the resilient clips 444 which hold those sensors are embedded within a "potting" material that can withstand vibration and shock without appreciable degradation. All of this means that the down-hole drill 251 and the tiltable coupling 253 need not be removed from the hole 456 when it becomes desirable to check the orientation of that tiltable coupling — and hence the orientation of the plunger 326. All that need be done is to halt the supplying of compressed air to the hoses 205 and 452 so the down-hole drill 251 will stop drilling and so the electrolyte within the various sensors 100, 102, 104 and 106 can come to rest. At such time, the readings obtained from the readout 468 will indicate the orientation of the tiltable coupling 253, and hence of the piston 326.

If desired, the left-hand end of the hollow gear 388 could have the teeth 392 extend all of the way around the periphery thereof, and the right-hand end of the rotatable element 264 could be continuous and could have internal teeth that corresponded to the internal teeth 394 in the sleeve 280. However, the use of the flat surfaces 278 and 385 and of the intervening roller 386 is preferred; because those surfaces and that roller minimize the frictional losses between the wobbling hollow gear 388 and the rotatable element 264.

The tiltable coupling 253 makes it possible to drill down into the ground to form a hole that is almost precisely vertical; and such a hole could be used as a "pilot" hole for an "up ream" hole or shaft. Specifically, the sensor 106 and its clip 444 could be set so the electrodes of that sensor would continue to lie in the plane which those electrodes define in FIG. 15 and which is parallel to the axis of the tiltable coupling 253, but those electrodes would be inclined at an angle of just 35°, rather than 55° relative to that axis; and the sensor 102 and its clip 444 could be set so the electrodes of that sensor would define a plane which passed through the axis of the tiltable coupling 253 and which was at right angles to the plane of the paper in FIG. 15, and those electrodes would extend to the right in FIG. 16 but would incline inwardly toward that axis at an angle of 35°. When so set, those sensors would sense, and would enable the readout 468 to indicate, a departure from a precisely-vertical axis of as small as four minutes of a degree. Further, the piston 326, the protuberance 358 and the bearing point 309 could be selectively used to force the down-hole drill 251 to promptly compensate for any departure from the precisely-vertical axis by forcing the hole to move back to that axis. By making it possible to sense a departure from a precisely-vertical axis of as small as 4 minutes of a degree, and by making it possible to promptly compensate for any departure from the precisely-vertical axis, the reset sensors 102 and 106 and the piston 326, the protuberance 358 and the bearing point 309 make it possible to limit departures from a precisely vertical axis to as little as one and four-tenths inches per 100 feet of hole depth.

In those instances where the drilled hole is dry, a water pump, not shown, will be used to add about a gallon of soapy water to the air passing to and through the hose 203. However, where water tends to accumulate within the drilling hole, that soapy water may not be needed.

If desired, the pin 342 which serves as a stop for the piston 326 could be set further inwardly of the chamber 324. In that event, the roller 334 rather than the bearing point 309 would constitute the third point of engagement between the tiltable coupling 253 and the inner surface of the hole 456. Such an arrangement would minimize the frictional forces between that tiltable coupling and that hole.

In one preferred embodiment of the present invention, the diameter of the sleeve 280 of the tiltable coupling 253 is approximately 3 inches, and the protuberance 358 projects four-tenths of an inch radially outwardly beyond the periphery of that sleeve. The protuberance 360 will project radially outwardly beyond that periphery by that same amount. The overall length of that tiltable coupling is slightly longer than 2 feet.

The sensors 100, 102, 104 and 106 differ from the potentiometers in U.S. Pat. No. 3,571,937 by being usable to help the tiltable coupling 253 guide the down-hole drill 251, whereas those potentiometers merely help indicate the orientation and curvature of the hole after it has been drilled. Moreover, the sensors 100, 102, 104 and 106 can be given various desired orientations relative to the axis of the tiltable coupling to enable those sensors to indicate even small departures of that axis from a desired straight or curved line. Where the tiltable coupling 253 is used to guide a down-hole drill during the forming of a hole in an esentially-vertical plate, the appropriate sensor or sensors in that tiltable coupling preferably will be set to assume an attitude or attitudes of high sensitivity during the forming of that hole. Thus, in the forming of the hole in FIG. 6, the sensor 106 should be set so the electrodes thereof are parallel to the axis of and are directed toward the rear of, the tiltable coupling 253 during the forming of that hole. In such event, those electrodes would be displaced 30° from true vertical during the forming of the straight section 122, and thus would enable that sensor to provide a high degree of sensitivity to the inclination of that straight section. Subsequently, during the forming of the curved section 126 of the hole in FIG. 6, the electrodes of the sensor 106 would be displaced 45° from true vertical and would tend to provide a high degree of sensitivity to the inclination of that curved section. In the forming of the hole 259 in FIG. 7, the sensor 106 again should be parallel to the axis of, and should again be directed toward the rear of, the tiltable coupling 253. In such event, those electrodes would be displaced about 30° to the right of true vertical during the forming of the initial portions of that hole, and thus would cause that sensor to provide a high degree of sensitivity to the inclination of that initial portion; and those electrodes would be displaced about 30° to the left of true vertical during the forming of the final portions of that hole, and thus would cause that sensor to provide a high degree of sensitivity to the inclination of that final portion. In the forming of the hole 256 in FIG. 7, the sensor 106 should be parallel to the axis of, but should be directed toward the front of the tiltable coupling 253. In such event, those electrodes would be displaced about 30° to the left of true vertical during the forming of the initial portions of that hole, and thus would cause that sensor to provide a high degree of sensitivity to the inclination of that initial portion; and those electrodes would be displaced about 30° to the right of true vertical during the forming of the final portions of that hole, and thus would cause that sensor to provide a high degree of sensitivity to the inclination of that final portion. In this way, the present invention makes it possible to control the orientation of a drilled hole with a high degree of precision, whereas the potentiometers of the said patent merely help make a record of an already-drilled hole.

The fulcrum 356 preferably will be located about half-way between the front end of the down-hole drill 251 and the rear end of the tiltable coupling 253. Where that is done, and where that tiltable coupling is being used to cause that down-hole drill to drill a section of a hole in a generally-horizontal plane, the weight of that down-hole drill will come close to balancing the weight of that tiltable coupling. This is desirable because it will keep the weight of that down-hole drill from tending to incline the section of hole downwardly relative to the horizontal; and it also is desirable because it will keep the weight of that tiltable coupling from tending to incline the section of hole upwardly relative to the horizontal.

Whereas the drawing and accompanying description have shown and described two preferred embodiments of the present invention, it should be apparent to those skilled in the art that various changes may be made in the form of the invention without affecting the scope thereof.

What I claim is:

1. A tiltable coupling, which can connect a down-hole drill to a section of drill rod string for said down-hole drill, which comprises means adjacent one end of said coupling that is selectively engageable with one side of a hole in which said tiltable coupling is disposed, further means adjacent the opposite end of said coupling that is selectively engageable with an angularly-displaced side of said hole, the first said means being at one side of said tiltable coupling and said further means being at an angularly-displaced side of said tiltable coupling, said first said means and said further means coacting, whenever said first said means is in engagement with said one side of said hole and said further means is in engagement with said angularly-displaced side of said hole, to force the axis of said down-hole drill to be inclined to the axis of the section of said hole in which said tiltable coupling is disposed to cause said down-hole drill to drill a curved section of said hole, said first said means being selectively disposable out of engagement with all sides of said hole while said further means also is disposable out of engagement with all sides of said hole to permit said axis of said down-hole drill to be essentially parallel to said axis of said section of said hole in which said tiltable coupling is disposed, and thereby enable said down-hole drill to drill an undeflected section of said hole, at least one of said means being movable into engagement with the adjacent side of said hole by fluid under pressure, said drill rod string and said tiltable coupling supplying fluid to said down-hole drill to actuate said down-hole drill, and a fluid-supplying means which selectively supplies said fluid under pressure to said tiltable coupling to selectively cause said one of said means to move into engagement with said adjacent side of said hole, and said fluid-supplying means isolating said fluid under pressure from said fluid in said drill rod string until after said fluid under pressure has issued from said fluid-supplying means.

2. A tiltable coupling which can connect a down-hole drill to a section of drill rod string for said down-hole drill, which comprises means adjacent one end of said coupling that is selectively engageable with one side of a hole in which said tiltable coupling is disposed, further means adjacent the opposite end of said coupling that is selectively engageable with an angularly-displaced side of said hole, the first said means being at one side of said tiltable coupling and said further means being at an angularly-displaced side of said tiltable coupling, said first said means and said further means coacting, whenever said first means is in engagement with said one side of said hole and said further means is in engagement with said angularly-displaced side of said hole, to force the axis of said down-hole drill to be inclined to the axis of the section of said hole in which said tiltable coupling is disposed to cause said down-hole drill to drill a curved section of said hole, said first said means being selectively disposable out of engagement with all sides of said hole while said further means also is disposable out of engagement with all sides of said hole to permit said axis of said down-hole drill to be essentially parallel to said axis of said section of said hole in which said tiltable coupling is disposed, and thereby enable said down-hole drill to drill an undeflected section of said hole, said drill rod string and said tiltable coupling supplying fluid to said down-hole drill to actuate said down-hole drill, one of said means comprising a piston that is movable laterally of said tiltable coupling to apply a force to the adjacent side of said section of said hole which will force the opposite side of said down-hole drill away from said adjacent side of said section of said hole and thereby incline said axis of said tiltable coupling relative to said axis of said section of said hole, and isolating means to isolate said piston from said fluid which said drill rod string and said tiltable coupling supply to said down-hole drill.

3. A tiltable coupling which can connect a down-hole drill to a section of drill rod string for said down-hole drill, which comprises means adjacent one end of said coupling that is selectively engageable with one side of a hole in which said tiltable coupling is disposed, further means adjacent the opposite end of said coupling that is selectively engageable with an angularly-displaced side of said hole, the first said means being at one side of said tiltable coupling and said further means being at an angularly-displaced side of said tiltable coupling, said first said means and said further means coacting, whenever said first said means is in engagement with said one side of said hole and said further means is in engagement with said angularly-displaced side of said hole to force the axis of said down-hole drill to be inclined to the axis of the section of said hole in which said tiltable coupling is disposed to cause said down-hole drill to drill a curved section of said hole, said first said means being selectively disposable out of engagement with all sides of said hole while said further means also is disposable out of engagement with all sides of said hole to permit said axis of said down-hole drill to be essentially parallel to said axis of said section of said hole in which said tiltable coupling is disposed, and thereby enable said down-hole drill to drill an undeflected section of said hole, one of said means comprising a fixed protuberance at one side of said tiltable coupling, said fixed protuberance having the outermost portion thereof displaced from the axis of said tiltable coupling a distance less than the radius of said hole, whereby said fixed protuberance can permit the axis of the adjacent end of said tiltable coupling to be coaxial with said hole, said fixed protuberance having the outermost portion thereof displaced radially outwardly beyond the other end of said one side of said tiltable coupling a distance which essentially determines the inclination of said axis of said tiltable coupling relative to said axis of said section of said hole when said outermost portion of said fixed protuberance and said other end of said one side of said tiltable coupling simultaneously engage the adjacent side of said section of said hole, the other of said means comprising a piston that is movable laterally of said tiltable coupling to apply a force to said angularly-displaced side of said section of said hole, and said fixed protuberance and said laterally-movable piston coacting whenever said fixed protuberance and said other end of said one side of said tiltable coupling engage said adjacent side of said section of said hole and said piston simultaneously engages said angularly-displaced side of said section of said hole to incline said axis of said tiltable coupling relative to said axis of said section of said hole at a fixed and predetermined angle, said laterally-movable piston being selectively disposable in engagement with or out of engagement with said angularly-displaced side of said section of said hole while said down-hole drill is deepening said hole.

4. A tiltable coupling which can connect a down-hole drill to a section of drill rod string for said down-hole drill, which comprises means adjacent one end of said coupling that is selectively engageable with one side of a hole in which said tiltable coupling is disposed, further means adjacent the opposite end of said coupling that is selectively engageable with an angularly-displaced side of said hole, the first said means being at one side of said tiltable coupling and said further means being at an angularly-displaced side of said tiltable coupling, said first said means and said further means coacting, whenever said first said means is in engagement with said one side of said hole and said further means is in engagement with said angularly-displaced side of said hole to force the axis of said down-hole drill to be inclined to the axis of the section of said hole in which said tiltable coupling is disposed to cause-said down-hole drill to drill a curved section of said hole, said first said means being selectively disposable out of engagement with all sides of said hole while said further means also is disposable out of engagement with all sides of said hole to permit said axis of said down-hole drill to be essentially parallel to said axis of said section of said hole in which said tiltable coupling is disposed, and thereby enable said down-hole drill to drill an undeflected section of said hole, one of said means comprising a piston that has a roller at the outer end thereof, said piston being movable laterally of said tiltable coupling to cause said roller to apply a force to the adjacent side of said section of said hole which will incline said axis of said tiltable coupling relative to said axis of said section of said hole, and means to selectively hold said laterally-movable piston radially inwardly of said adjacent side of said hole while said down-hole drill is deepening said hole.

5. A tiltable coupling which can connect a down-hole drill to a section of drill rod string for said down-hole drill, which comprises means adjacent one end of said coupling that is selectively engageable with one side of a hole in which said tiltable coupling is disposed, further means adjacent the opposite end of said coupling that is selectively engageable with an angularly-displaced side of said hole, the first said means being at one side of said tiltable coupling and said further means being at an angularly-displaced side of said tiltable coupling, said first said means and said further means coacting, whenever said first said means is in engagement with said one side of said hole and said further means is in engagement with said angularly-displaced side of said hole, to force the axis of said down-hole drill to be inclined to the axis of the section of said hole in which said tiltable coupling is disposed to cause said down-hole drill to drill a curved section of said hole, said first said means being selectively disposable out of engagement with all sides of said hole while said further means also is disposable out of engagement with all sides of said hole to permit said axis of said down-hole drill to be essentially parallel to said axis of said section of said hole in which said tiltable coupling is disposed, and thereby enable said down-hole drill to drill an undeflected section of said hole, drill rod string and said tiltable coupling supplying fluid to said down-hole drill to actuate said down-hole drill, one of said means comprising a piston that has a roller at the outer end thereof, said piston being movable laterally of said tiltable coupling to cause said roller to apply a force to the adjacent side of said section of said hole which will incline said axis of said tiltable coupling relative to said axis of said section of said hole, and said roller coacting with said adjacent side of said section of said hole, as said down-hole drill moves deeper into said hole, to apply a circumferentially-directed component of reactive force to said tiltable coupling.

6. A tiltable coupling which can connect a down-hole drill to a section of drill rod string for said down-hole drill and which comprises means that can permit the axis of said down-hole drill to be inclined to the axis of the section of a hole in which said tiltable coupling is disposed to cause said down-hole drill to drill a curved section of said hole, said means comprising a piston that is movable laterally relative to a given portion of the length of said tiltable coupling to apply a force to said section of said hole and to apply a laterally-directed reaction force to said given portion of said length of said tiltable coupling, a second piston that is movable laterally relative to said given portion of said length of said tiltable coupling to apply an oppositely-directed second force to said section of said hole and to apply an oppositely-directed reaction force to said given portion of said length of said tiltable coupling, the first said piston having a recess therein, said second piston being positioned within and being movable axially relative to said recess, and the first said and said second forces resisting circumferential movement of said tiltable coupling relative to said section of said hole.

7. A tiltable coupling which can connect a percussion-type down-hole drill to a section of drill rod string for said down-hole drill and which comprises means adjacent one end of said coupling that is selectively engageable with one side of a hole in which said tiltable coupling is disposed, further means adjacent the opposite end of said coupling that is selectively engageable with an angularly-displaced side of said hole, the first said means being at one side of said tiltable coupling and said further means being at an angularly-displaced side of said tiltable coupling, said first said means and said further means coacting, whenever said first said means is in engagement with said one side of said hole and said further means is in engagement with said angularly-displaced side of said hole to force the axis of said down-hole drill to be inclined to the axis of the section of said hole in which said tiltable coupling is disposed to cause said down-hole drill to drill a curved section of said hole, an air motor that is located within said tiltable coupling, a torque multiplier that is connected between said air motor and said down-hole drill to enable said air motor to apply strong rotative forces to said down-hole drill, said torque multiplier including a pair of confronting faces and an intermediate roller, said torque multiplier including a means to wobble one of said confronting faces and thereby cause said roller to rotate the other of said confronting faces, and said air motor responding to compressed air passing through said drill rod string to cause said torque multiplier to rotate said down-hole drill.

8. A tiltable coupling which can connect a down-hole drill to a section of drill rod string for said down-hole drill and which comprises means adjacent one end of said coupling that is selectively engageable with one side of a hole in which said tiltable coupling is disposed, further means adjacent the opposite end of said coupling that is selectively engageable with an angularly-displaced side of said hole, the first said means being at one side of said tiltable coupling and said further means being at an angularly-displaced side of said tiltable coupling, said first said means and said further means coacting, whenever said first said means is in engagement with said one side of said hole and said further means is in engagement with said angularly-displaced side of said hole, to force the axis of said down-hole drill to be inclined to the axis of the section of said hole in which said tiltable coupling is disposed to cause said down-hole drill to drill a curved section of said hole, said drill rod string acting as a conduit to supply fluid under pressure to said tiltable coupling and thus to said down-hole drill, and an elongated hose that extends through said hole in parallel relation with said drill rod string and that is connected to said tiltable coupling to selectively supply further fluid under pressure to said tiltable coupling, said drill rod string being held against rotation whenever said down-hole drill is deepening said hole.

9. A tiltable coupling as claimed in claim 8 wherein a sensor is disposed within said tiltable coupling to sense the attitude of said tiltable coupling, and wherein the major portions of the lengths of the leads for said sensor are located within and are protected by said elongated hose.

10. A tiltable coupling which can connect a percussion-type down-hole drill to a section of drill rod string for said down-hole drill and which comprises means adjacent one end of said coupling that is selectively engageable with one side of a hole in which sad tiltable coupling is disposed, further means adjacent the opposite end of said coupling that is selectively engageable with an angularly-displaced side of said hole, the first said means being at one side of said tiltable coupling and said further means being at an angularly-displaced side of said tiltable coupling, said first said means and said further means coacting, whenever said first said means is in engagement with said one side of said hole and said further means is in engagement with said angularly-displaced side of said hole, to force the axis of said down-hole drill to be inclined to the axis of the section of said hole in which said tiltable coupling is disposed to cause said down-hole drill to drill a curved section of said hole, an air motor that is located within said tiltable coupling and that can respond to fluid under pressure passing through said drill rod string to rotate said down-hole drill, said air motor having a hollow rotor that is connected to a rotatable member to rotate said rotatable member and to supply fluid under pressure to said rotatable member, a pin that extends through said hollow rotor to connnect said hollow rotor to said rotatable member, and portions of the wall of said hollow rotor which are adjacent said pin being cut away to keep the presence of said pin from decreasing the effective fluid-transmitting cross section of said hollow rotor, said air motor rotating said down-hole drill at such a slow rate that said down-hole drill effectively deepens said hole by percussive action rather than by rotary action.

11. A tiltable coupling which can connect a down-hole drill to a section of drill rod string for said down-hole drill, said tiltable coupling having longitudinally-spaced and angularly-displaced surfaces that are selectively engageable with longitudinally-spaced and angularly-displaced portions of the surface of a hole in which said tiltable coupling is disposed, said longitudinally-spaced and angularly-displaced surfaces being simultaneously engageable with said longitudinally-spaced and angularly-displaced portions of the surface of said hole to incline the axis of said down-hole drill to the axis of the section of said hole in which said tiltable coupling is disposed, a sensor that is disposed within said tiltable coupling, said sensor being usable, during periods when said down-hole drill is attached to said tiltable coupling but said down-hole drill is inactive and hence is not deepening said hole, to help indicate the orientation of said tiltable coupling within said hole, said sensor having a movable portion which moves readily and with minimal friction to indicate changes in the attitude of said tiltable coupling but which is not degraded by fatigue or impact.

12. A tiltable coupling which can connect a down-hole drill to a section of drill rod string for said down-hole drill, said tiltable coupling having longitudinally-spaced and angularly-displaced surfaces that are selectively engageable with longitudinally-spaced and angularly-displaced portions of the surface of a hole in which said tiltable coupling is disposed, said longitudinally-spaced and angularly-displaced surfaces being simultaneously engageable with said longitudinally-spaced and angularly-displaced portions of the surface of said hole to incline the axis of said down-hole drill to the axis of the section of said hole in which said tiltable coupling is disposed, a sensor that is disposed within said tiltable coupling, said sensor including a plurality of electrodes and an electrolyte, the axis of said sensor being inclined relative to the axis of said tiltable coupling to cause said electrolyte to occupy a position of great sensitivity whenever said tiltable coupling is in a predetermined attitude, said electrolyte and said electrodes being resistant to, and not degradable by, fatigue or impact.

13. A tiltable coupling which can connect a down-hole drill to a section of drill rod string for said down-hole drill, said tiltable coupling having longitudinally-spaced and angularly-displaced surfaces that are selectively engageable with longitudinally-spaced and angularly-displaced portions of the surface of a hole in which said tiltable coupling is disposed, said longitudinally-spaced and angularly-displaced surfaces being simultaneously engageable with said longitudinally-spaced and angularly-displaced portions of the surface of said hole to incline the axis of said down-hole drill to the axis of the section of said hole in which said tiltable coupling is disposed, a sensor that is disposed within said tiltable coupling, a second sensor that is disposed within said tiltable coupling, each of said sensors including a plurality of electrodes and an electrolyte, the electrodes of the first said sensor defining a plane, the electrodes of said second sensor defining a second plane which is at right angles to the first said plane, said electrolyte and said electrodes of said first said sensor being resistant to and not degradable by, fatigue or impact, and said electrolyte and said electrodes of said second sensor being resistant to, and not degradable by, fatigue or impact.

14. A tiltable coupling which can connect a down-hole drill to a section of drill rod string for said down-hole drill, said tiltable coupling having longitudinally-spaced and angularly-displaced surfaces that are selectively engageable with longitudinally-spaced and angularly-displaced portions of the surface of a hole in which said tiltable coupling is disposed, said longitudinally-spaced and angularly-displaced surfaces being simultaneously engageable with said longitudinally-spaced and angularly-displaced portions of the surface of said hole to incline the axis of said down-hole drill to the axis of the section of said hole in which said tiltable coupling is disposed, a sensor that is disposed within said tiltable coupling, said one of said longitudinally-spaced and angularly-displaced surfaces being on a piston that is movable laterally of said tiltable coupling, and the axis of said sensor having a fixed relation to the direction of movement of said piston, said sensor having a movable portion which moves readily and which is resistant to, and not degradable by, fatigue or impact.

15. A tiltable coupling which can connect a down-hole drill to a section of drill rod string for said down-hole drill, said tiltable coupling having longitudinally-spaced and angularly-displaced surfaces that are selectively engageable with longitudinally-spaced and angularly-displaced portions of the surface of a hole in which said tiltable coupling is disposed, said longitudinally-spaced and angularly-displaced surfaces being simultaneously engageable with said longitudinally-spaced and angularly-displaced portions of the surface of said hole to incline the axis of said down-hole drill to the axis of the section of said hole in which said tiltable coupling is disposed, a sensor that is disposed within said tiltable coupling, said drill rod string acting as a conduit to supply fluid under pressure to said tiltable coupling and thus to said down-hole drill, an elongated hose that extends through said hole in parallel relation with said drill rod string and that is connected to said tiltable coupling to selectively supply fluid under pressure to said tiltable coupling, conductors that are electrically connectable to said sensor and that are disposed within said elongated hose, a short length of hose that extends from a point on said elongated hose to said tiltable coupling to conduct said conductors from said point on said elongated hose to said tiltable coupling, and coupling means that provide fluid-type connections between said short length of hose and said point on said elongated hose and also between said short length of hose and said tiltable coupling, said sensor having a movable portion which moves readily and being resistant to, and not degradable by, fatigue or impact.

16. A tiltable coupling, which can connect a down-hole drill to a section of drill rod string for said down-hole drill, which comprises a first member that is securable to said down-hole drill, a second member that is securable to said section of drill rod string, confronting surfaces on said first and second members that can selectively abut each other, said confronting surfaces having a predetermined maximum amount of clearance therebetween to fix the maximum tilt angle between the axes of said first and second members, and thereby fix the maximum tilt angle between the axis of said down-hole drill and the axis of said section of said drill rod string, a bushing that is mounted on said section of drill rod string at a point which is displaced from said second member, the spacing between said bushing and said second member being long enough to enable simultaneous engagement of said bushing and of said second member with spaced points on the surface of a hole, being drilled by said down-hole drill, to hole a substantial portion of the length of that section of said drill rod string which is secured to said second member out of engagement with said surface of said hole, and said bushing acting as a fulcrum to enable said section of said drill rod string which is secured to said second member to urge said second member against said surface of said hole.

17. A tiltable coupling which can connect a down-hole drill to a section of drill rod string for said down-hole drill, said tiltable coupling having longitudinally-spaced and angularly-displaced surfaces that are selectively engageable with longitudinally-spaced and angularly-displaced portions of the surface of a hole in which said tiltable coupling is disposed, said longitudinally-spaced and angularly-displaced surfaces being simultaneously engageable with said longitudinally-spaced and angularly-displaced portions of the surface of said hole to incline the axis of said down-hole drill to the axis of the section of said hole in which said tiltable coupling is disposed, said drill rod string acting as a conduit to supply fluid under pressure to said tiltable coupling and thus to said down-hole drill, an elongated hose that extends through said hole externally of and in parallel relation with said drill rod string and that is connected to said tiltable coupling to selectively supply fluid under pressure to said tiltable coupling, one of said longitudinally-spaced and angularly-displaced surfaces being on a piston that is movable laterally of said tiltable coupling, and said piston moving laterally of said tiltable coupling whenever said elongated hose supplies fluid under pressure to said tiltable coupling.

18. A tiltable coupling which can connect a down-hole drill to a section of drill rod string for said down-hole drill, said tiltable coupling having longitudinally-spaced and angularly-displaced surfaces that are selectively engageable with longitudinally-spaced and angularly-displaced portions of the surface of a hole in which said tiltable coupling is disposed, said longitudinally-spaced and angularly-displaced surfaces being simultaneously engageable with said longitudinally-spaced and angularly-displaced portions of the surface of said hole to incline the axis of said down-hole drill to the axis of the section of said hole in which said tiltable coupling is disposed, one of said longitudinally-spaced and angularly-displaced surfaces being on a piston that is movable laterally of said tiltable coupling, means to conduct fluid under pressure to said tiltable coupling and said piston being movable, laterally of said tiltable coupling by said fluid under pressure, a valve that is mounted on said tiltable coupling and that initially causes said fluid under pressure to move said piston laterally of said tiltable coupling, and said valve subsequently moving to permit said fluid under pressure to pass to said down-hole drill.

19. A tiltable coupling which can connect a down-hole drill to a section of drill rod string for said down-hole drill, said tiltable coupling having longitudinally-spaced and angularly-displaced surfaces that are selectively engageable with longitudinally-spaced and angularly-displaced portions of the surface of a hole in which said tiltable coupling is disposed, said longitudinally-spaced and angularly-displaced surfaces being simultaneously engageable with said longitudinally-spaced and angularly-displaced portions of the surface of said hole to incline the axis of said down-hole drill to the axis of the section of said hole in which said tiltable coupling is disposed, one of said longitudinally-spaced and angularly-displaced surfaces being on a fulcrum, said fulcrum being on a portion of said tiltable coupling which is selectively disposable at different positions circumferentially relative to the other end of said tiltable coupling, and locking means which selectively permits circumferential adjustment of the position of said fulcrum relative to said other end of said tiltable coupling but which prevents accidental shifting of said fulcrum circumferentially of said other end of said tiltable coupling.

20. A tiltable coupling which can connect a down-hole drill to a section of drill rod string for said down-hole drill, said tiltable coupling having longitudinally-spaced and angularly-displaced surfaces that are selectively engageable with longitudinally-spaced and angularly-displaced portions of the surface of a hole in which said tiltable coupling is disposed, said longitudinally-spaced and angularly-displaced surfaces being simultaneously engageable with said longitudinally-spaced and angularly-displaced portions of the surface of said hole to incline the axis of said down-hole drill to the axis of the section of said hole in which said tiltable coupling is disposed, one of said longitudinally-spaced and angularly-displaced surfaces being movable outwardly relative to said tiltable coupling in response to fluid under pressure, said drill rod string and said tiltable coupling selectively supplying fluid to said down-hole drill to selectively actuate said down-hole drill, and a fluid-supplying means which supplies fluid under pressure to said tiltable coupling to move said one of said longitudinally-spaced and angularly-displaced surfaces being movable outwardly relative to said tiltable coupling, said fluid-supplying means being able to supply said fluid under pressure to said tiltable coupling even when said drill rod string and said tiltable coupling are not supplying to said down-hole drill.

21. A tiltable coupling as claimed in claim 20 wherein said drill rod string is non-rotating when said down-hole drill is actuated, and wherein said fluid-supplying means includes an elongated conduit which is located between said drill rod string and said hole.

22. A tiltable coupling as claimed in claim 20 wherein said fluid-supplying means isolates said fluid under pressure from said fluid in said drill rod string until after said fluid under pressure has issued from said fluid-supplying means.

23. A tiltable coupling as claimed in claim 20 wherein said tiltable coupling supplies some of said fluid under pressure to said down-hole drill to help actuate said down-hole drill.

24. A tiltable coupling as claimed in claim 20 wherein said drill rod string is non-rotating when said down-hole drill is actuaged, wherein an electric attitude sensor is disposed within said tiltable coupling to sense the attitude of said tiltable coupling, wherein said fluid-supplying means includes an elongated conduit which is located between said drill rod string and said hole, and wherein the major portions of the lengths of the leads for said electric attitude sensor are located within and are protected by said elongated conduit.

* * * * *

UNITED STATES PATENT OFFICE

CERTIFICATE OF CORRECTION

PATENT NO. 3,930,545

DATED January 6, 1976

INVENTOR(S) Howard V. Sears

It is certified that error appears in the above-identified patent and that said Letters Patent are hereby corrected as shown below:

Col. 33, Line 15 after the comma and before "drill" insert -- said --

Col. 34, Line 50 "said" is misspelled

Col. 37, Line 13 "hole" (last occurrence) should be -- hold --

Col. 38, Line 45 delete "being movable";

Line 49 after "supplying" and before "to" insert -- fluid --

Signed and Sealed this

Twenty-third Day of November 1976

[SEAL]

*Attest:*

RUTH C. MASON
*Attesting Officer*

C. MARSHALL DANN
*Commissioner of Patents and Trademarks*